US012747091B2

(12) United States Patent
Holbrook

(10) Patent No.: US 12,747,091 B2
(45) Date of Patent: Sep. 29, 2026

(54) CONICAL RISERS INTERCONNECTED BY RADIALLY AND CIRCUMFERENTIALLY DEFLECTING LATCHES

(71) Applicant: Infiltrator Water Technologies, LLC, Old Saybrook, CT (US)

(72) Inventor: Paul R Holbrook, Old Saybrook, CT (US)

(73) Assignee: Advanced Drainage Systems, Inc., Hilliard, OH (US)

( * ) Notice: Subject to any disclaimer, the term of this patent is extended or adjusted under 35 U.S.C. 154(b) by 367 days.

(21) Appl. No.: 18/528,313

(22) Filed: Dec. 4, 2023

(65) Prior Publication Data

US 2024/0101343 A1 Mar. 28, 2024

Related U.S. Application Data

(63) Continuation-in-part of application No. 17/898,476, filed on Aug. 29, 2022, now Pat. No. 12,240,688, (Continued)

(51) Int. Cl.
*B65D 90/10* (2006.01)
*B65D 21/02* (2006.01)
(Continued)

(52) U.S. Cl.
CPC ..... *B65D 90/105* (2013.01); *B65D 21/0209* (2013.01); *B65D 21/0212* (2013.01); (Continued)

(58) Field of Classification Search
CPC ..... B65D 90/02; B65D 90/08; B65D 90/023; B65D 90/024; B65D 90/025; (Continued)

(56) References Cited

U.S. PATENT DOCUMENTS 2,803,348 A 8/1957 Bingham et al.
2,873,881 A 2/1959 Nichols
(Continued)

FOREIGN PATENT DOCUMENTS

DE 9407303 U1 7/1994
EP 0526744 A1 10/1994
(Continued)

*Primary Examiner* — Andrew D Perreault
(74) *Attorney, Agent, or Firm* — FINNEGAN, HENDERSON, FARABOW, GARRETT & DUNNER, LLP

(57) ABSTRACT

Risers for use in a riser assembly to provide access to below-grade chambers or vaults are provided. Risers may include an angled wall connecting a first end and a second end spaced apart along a central lengthwise axis. In an embodiment, the riser may include a plurality of latches spaced around the first end and the second end with radially extending lips and canted terminal end surfaces. A plurality of receivers may be spaced between the first plurality of latches on the first end and the second end. Alternatively, plurality of latches may include a first and second latch body extending to a terminal end that comprises a first circumferentially extending lip and a first canted terminal end surface. Risers may be configured to connect to other risers to form a riser assembly.

8 Claims, 24 Drawing Sheets

Related U.S. Application Data which is a continuation of application No. 15/432,780, filed on Feb. 14, 2017, now Pat. No. 11,427,400, which is a continuation-in-part of application No. 14/444,960, filed on Jul. 28, 2014, now Pat. No. 10,442,617.

(60) Provisional application No. 63/429,939, filed on Dec. 2, 2022, provisional application No. 63/429,937, filed on Dec. 2, 2022, provisional application No. 62/295,408, filed on Feb. 15, 2016.

(51) Int. Cl.

| | |
|---|---|
| ***B65D 21/08*** | (2006.01) |
| ***B65D 88/02*** | (2006.01) |
| ***B65D 88/52*** | (2006.01) |
| ***B65D 90/02*** | (2019.01) |
| ***B65D 90/08*** | (2006.01) |

(52) U.S. Cl.

CPC ..... *B65D 21/0234* (2013.01); *B65D 21/086* (2013.01); *B65D 88/025* (2013.01); *B65D 88/526* (2013.01); *B65D 90/024* (2013.01); *B65D 90/08* (2013.01)

(58) Field of Classification Search

CPC B65D 90/026; B65D 21/0234; B65D 88/025; B65D 88/526; B65D 88/528; B65D 21/08; B65D 21/083; B65D 21/086; B65D 90/105; B65D 21/0209; B65D 21/0235; B65D 2519/00945; E03F 11/00; E03F 5/00; E03F 5/02; E03F 5/024; E03F 2005/028; E03F 5/105; B60K 2015/03164; B60K 2015/03171; E02D 29/12; E02D 29/121; E02D 29/1409; F16L 47/10

USPC ..... 220/4.16, 795, 4.26, 4.03, 691, 4.06; 52/20, 79.3, 223.5; 285/420, 921, 110, 285/111; 210/170.08

See application file for complete search history.

(56) References Cited

U.S. PATENT DOCUMENTS

| | | | |
|---|---|---|---|
| 4,040,372 | A | 8/1977 | Flanders |
| 4,101,154 | A | 7/1978 | Kagstrom |
| 4,852,757 | A | 8/1989 | Gold |
| 5,378,357 | A | 1/1995 | Houck et al. |
| 5,617,679 | A | 4/1997 | Meyers |
| 5,697,500 | A | 12/1997 | Walker |
| 5,839,844 | A | 11/1998 | Nichols et al. |
| 6,488,440 | B1 | 12/2002 | Hill |
| 6,602,023 | B2 | 8/2003 | Crescenzi et al. |
| 7,926,510 | B1 | 4/2011 | Terry, III et al. |
| 7,997,031 | B2 | 8/2011 | Meyers |
| 2001/0003886 | A1 | 6/2001 | Mihalicz et al. |
| 2008/0267709 | A1 | 10/2008 | Terry |
| 2013/0336723 | A1 | 12/2013 | McKinney |
| 2015/0321835 | A1 | 11/2015 | Holbrook et al. |
| 2016/0002876 | A1 | 1/2016 | McKinney et al. |

FOREIGN PATENT DOCUMENTS

| | | | |
|---|---|---|---|
| EP | 0631019 | A1 | 5/1998 |
| FR | 2509343 | A1 | 1/1983 |

CONICAL RISERS INTERCONNECTED BY RADIALLY AND CIRCUMFERENTIALLY DEFLECTING LATCHES

CROSS-REFERENCES TO RELATED APPLICATIONS

This application is a continuation in part of U.S. patent application Ser. No. 17/898,476, filed Aug. 29, 2022, which is a continuation of patent application Ser. No. 15/432,780, filed Feb. 14, 2017, which claims benefit of provisional patent application Ser. No. 62/295,408 filed on Feb. 15, 2016 and which is a continuation in part of patent application Ser. No. 14/444,960, filed Jul. 28, 2014. This application also claims benefit of provisional patent application No. 63/429,937, filed Dec. 2, 2022, and provisional patent application No. 63/429,939, filed Dec. 2, 2022. The foregoing applications are hereby incorporated by reference in their entireties.

TECHNICAL FIELD

The present invention relates to molded plastic structures comprised of interlocked rings, useful as risers and manhole chambers, for providing access to such as buried septic tanks and utility lines, or as sidewalls of plastic storage tanks.

BACKGROUND

A purpose of a riser may be to provide a space which extends upwardly within soil, for example from the access port of a septic tank to, or near to, the surface of the soil in which the tank is buried. A riser may inhibit entry of surface water and soil into the tank. Risers have been sold commercially as separate rings which can be assembled as a riser assembly having a desired length (height). Often, there have been seals or other means aimed at preventing the passage of water at the joints between rings. Most commercially available risers are essentially short straight cylinders. Thus, they cannot be conveniently nested for economic shipment and storage.

Similar requirements are presented in connection with a hole in earth that provides access to a sewer line or other buried things by means of a manhole. A casing or liner, sometimes referred to as a chimney, extends downwardly from a manhole opening at the surface of the earth. Risers may encompass structures for septic tanks and the like, for manhole casings, or for structures which are of the nature of sidewalls of vertical tanks or other buried chambers.

A riser for a septic tank application may have a minimum diameter which is no less than the diameter of the access port on the top of a septic tank, which commonly is of about 60 cm. In the past, such risers have been provided either as a one piece structure or as a multiplicity of circular rings which may be screwed or bolted to each other to form the desired height assembly. A good fit and seal between the joints of the rings is desirable, along with minimum labor of assembly of riser sections. A riser may present an uppermost surface suitable for a lid with a good seal configuration between the lid and the riser, particularly under conditions where surrounding soil may be prone to intruding into the seal region, as can occur when a lid is removed for septic tank maintenance purposes. There is a further need for a means of connecting a new-configuration riser to the opening of existing or already installed septic tanks and the ends of large diameter pipe-ends.

Safety improvements designed to hinder the chance of a small person or pet from falling into the large diameter opening of a typical septic tank riser during such time as the riser lid is removed may be desired. For instance, a grating might be placed on top of the open riser or within the riser. Thus, it is desirable to have the option of such a feature while at the same time making the feature cost effective to encourage its use.

In another application for articles of the present invention, a generally cylindrical plastic tank for holding liquids or solids may have a vertical axis and sidewall configured in the same way as a riser for a septic tank; that is, the sidewall is comprised of connected-together rings.

Improved methods of forming joints between riser sections may also be desired. Such improved methods should contemplate flexible latches and corresponding receivers that may be snapped together by installers. Latches and receivers should form a secure connection that is easy to assemble yet simultaneously secure in that the latches may be difficult to unlock or disconnect without use of tools or destructive techniques.

SUMMARY

Aspects of the present disclosure include molded plastic risers and related structures in forms which are economical to manufacture, ship, and store. Additional aspects include a riser comprised of a multiplicity of identical rings which form assemblies having good joints. Another aspect includes safety grating for the new types of risers and an adapter for connecting the new types of risers to the tops of tanks and the ends of vertical pipes.

In an embodiment, there may be individual risers and assemblies of identical risers. Each riser may have a tapered side wall; that is, the circumscribing wall is in the shape of a truncated hollow cone, and a riser assembly may have an undulating wall. Each riser may have a first lengthwise end having a first diameter, and a second lengthwise end having a smaller second diameter. Each riser end may include a plurality of tabs circumferentially spaced apart by rim segments. In some risers, each tab may have a body, at the end of which may be a radially-extending lip shaped for latching engagement with the rim segment of a mated same-size end identical riser. In an embodiment, each tab may include a body that is spaced apart from the exterior wall surface of the riser by a channel, and the lip may extend radially over the channel. In another embodiment, the lips of the tabs at the larger end of the riser may run inwardly and the lips at the tabs at the smaller end of the riser may run outwardly.

In further embodiments, the riser may include tabs having circumferential direction edges which are angled with respect to a plane within which lies the center longitudinal axis. The riser may include a wall having a circumferential step which is closer in diameter to the smaller diameter second end than to the first end for receiving the legs of a grating. The riser may include a joint within which is captured a circumferential seal.

Some embodiments may include a safety grating for use within a riser comprises a hub and a multiplicity of arms attached to and extending radially outward from the hub. The arms may be hinged where they attach to the hub, or at a location somewhat spaced apart from the hub. Thus, the grating can be sized to enable the grating to fit through the smaller-opening end of a riser of the kind described above, so the grating may be moved lengthwise within the undulating wall riser. In an embodiment, the grating may rest on a ledge or step molded on the interior of the wall of the riser.

In other embodiments, an adapter comprising a flange end and a step-diameter end may be configured to be alternatively attached by the adapter flange to a septic tank opening or attached to the end of a pipe. The adapter may have an interior ledge that enables attachment to the adapter of a riser to the opening of a septic tank that was principally intended to receive a screwed or bolted flange.

In further embodiments, the riser may have a first plurality of latches spaced around the first end and extending to a first terminal end, each latch including a radially extending lip and a canted terminal end surface, wherein the radially extending lip and the canted terminal end surface extend away from the central lengthwise axis. The riser may also include a first plurality of receivers spaced between the first plurality of latches wherein each of the first plurality of receivers includes a first bar extending away from the central lengthwise axis in a circumferential direction around the first end to define a first receiver opening. The second end of the riser may include a second plurality of latches spaced around the second end and extending to a second terminal end that includes a radially extending lip and a canted terminal end surface, wherein the radially extending lip and the canted terminal end extend towards the central lengthwise axis. The second end may also include a second plurality of receivers spaced between the second plurality of latches wherein each of the second plurality of receivers includes a second bar extending towards the central lengthwise axis in a circumferential direction around the second end to define a second receiver opening. First ends of risers of this embodiment may be configured to form joints with first ends of like kind risers. Similarly, second ends of risers of this embodiment may be configured to form joints with second ends of like kind risers. In this way, the canted terminal end surfaces of a riser contact the bar portion of a corresponding riser and the radially extending lip is deflected radially inwardly. Forming joints between like risers allows creation of a riser assembly.

In some embodiments, the riser assembly may include a first diameter and a second diameter, wherein the first diameter is larger than the second diameter. In other embodiments, the plurality of latches may include a tapered wall extending from the first end of the first terminal end. In other embodiments, the plurality of receivers may include a tapered wall extending from the first end to the first bar. The circumferential ends of receivers may be closed, or in some embodiments, one end of a receiver may be open.

In further embodiments, the first plurality of latches spaced around the first end of a riser may include a first latch body and a second latch body, each latch body extending to a terminal end and including a circumferentially extending lip and a canted terminal end surface. An embodiment may include a plurality of receivers spaced between the plurality of latches wherein each of the plurality of receivers includes a bar extending towards the central lengthwise axis in a circumferential direction to define a receiver opening. In an embodiment, latches with first and second latch bodies may be configured to deflect circumferentially inward by contact on the terminal end surfaces with the bar portions of a corresponding riser. In some embodiments, the riser further includes one or more guide posts configured to be inserted into a receiving slot of a corresponding second riser.

The foregoing and other objects, features and advantages of the present invention will become more apparent from the following description of preferred embodiments and accompanying drawings.

DETAILED DESCRIPTION

In accordance with disclosed embodiments, molded plastic riser articles (sometimes referred to as rings) can be used individually or as assemblies. As will be seen, risers may have inward or outward tapering walls, also referred to as conical walls. For simplicity of description, the risers and riser assemblies are often described herein using terminology applicable to cylindrical shapes. While some embodiments are described in terms of circular rings/risers, other embodiments may contemplate articles which have walls which are non-circular, such as oblong or other shapes.

Aspects of the present disclosure include a riser for a septic tank. A riser may be an open-ended structure which may be closed by a lid when positioned on a tank. In some embodiments, a riser may be mated with one or more other risers to form a riser assembly, which may sometimes be referred to as a riser in the art. In this description and elsewhere, a single riser piece may be alternatively referred to as a ring. Various embodiments of risers and riser assemblies may be provided. These and other features of the disclosed embodiments are discussed in more detail below.

Figure 1:
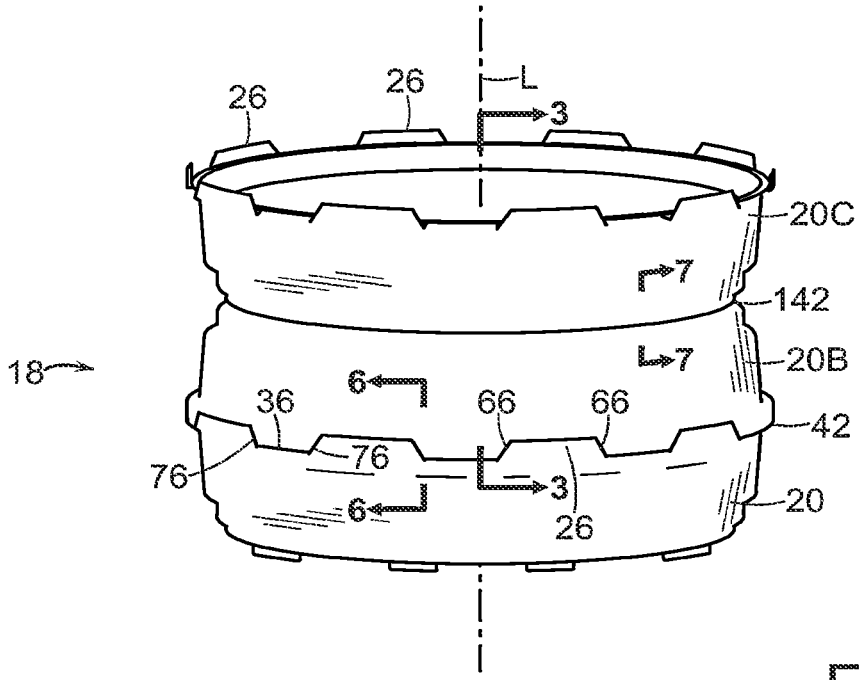
FIG. 1 is a perspective view of a riser assembly comprised of identical risers.
Figure 2:
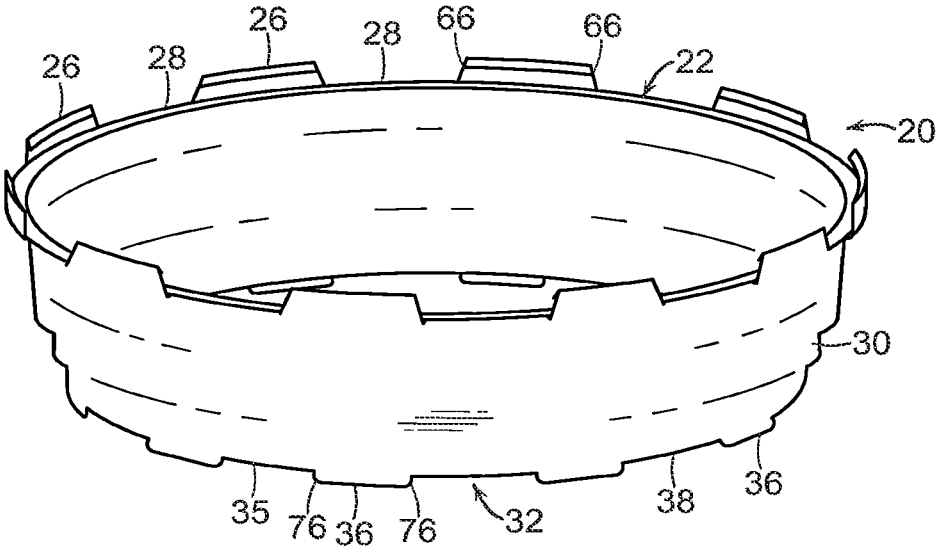
FIG. 2 is a perspective view of a riser which is part of the assembly of FIG. 1.
Figure 3:
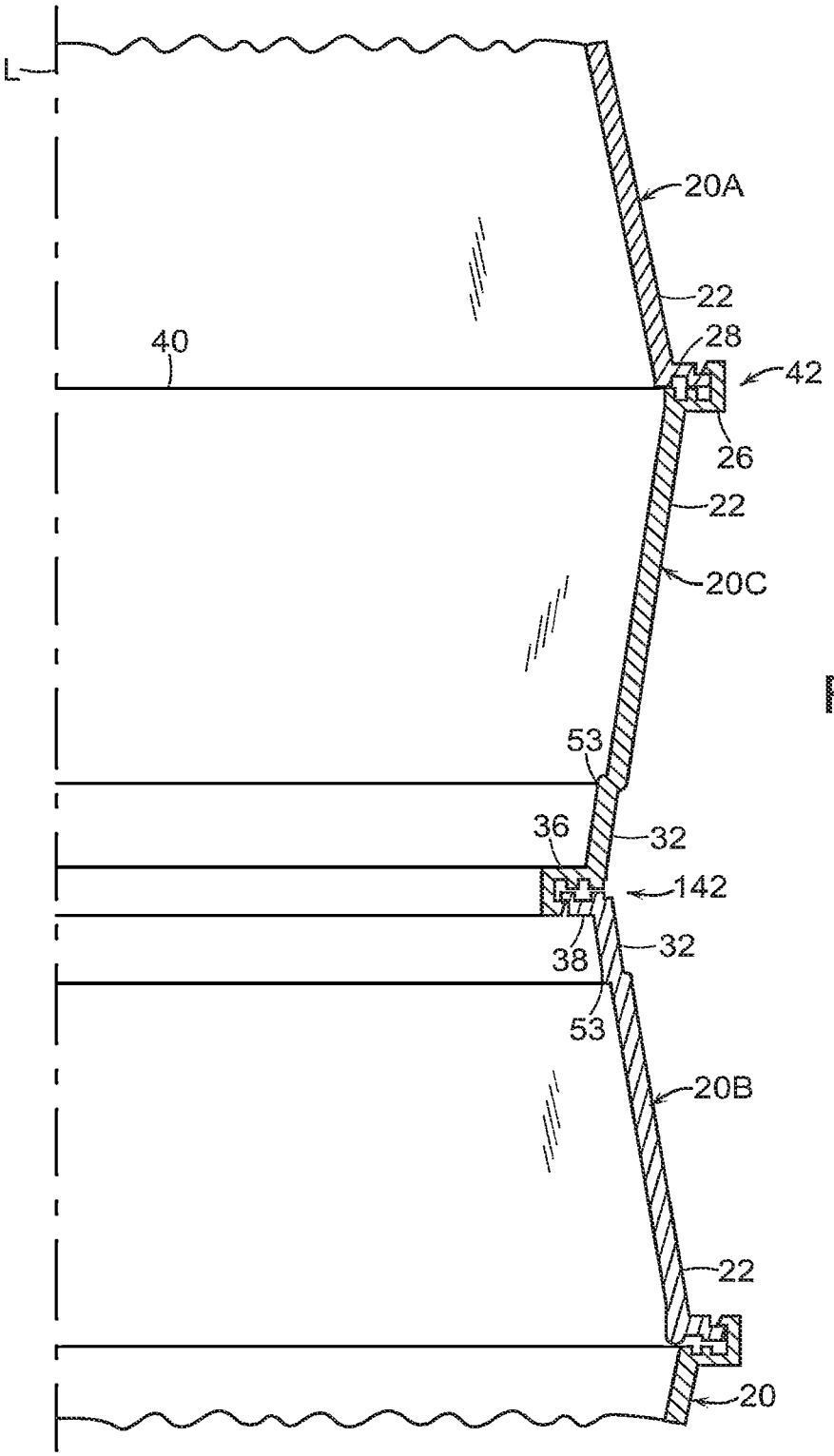
FIG. 3 is a partial vertical cross section through the riser assembly of FIG. 1, with an additional riser added at the top of the assembly.

FIG. 1 is an elevation perspective view, showing three identical risers 20, 20B, 20C that are joined to each other as riser assembly 18. A single riser 20 is shown in FIG. 2. FIG. 3 is a cross section through the assembly of FIG. 1, and includes an additional riser 20A. The small end of riser 20B mates with the small end of riser 20C at joint 142. The large end of riser 20A mates with the large end of riser 20C at joint 42. The wall of the riser assembly undulates in the lengthwise direction, so the wall is close to the central axis at circumferential joints 142 and distant at circumferential joints 42.

In an embodiment, a riser assembly may comprise two or more mated and latched-together articles. A riser assembly may sometimes be simply called a riser herein, particularly when the assembly is installed in a working position. When installed on a septic tank, a riser assembly is typically fastened to a fitting around the opening in the top of the tank and the assembly may have a lid closure at its top.

In an embodiment, riser 20 may have a vertical height of about 15 cm (about 6 inch), a larger diameter end of about 69 cm (about 27 inch) and a smaller diameter end of about 58 cm (about 23 inch). In other embodiments, risers may have heights in the range 2 to 18 inches (5 to 46 cm). Joints between several identical risers 20 may be formed by tabs on one riser that engage rim segments on the corresponding mating part of another riser by latching to them. A riser may be made of injection molded thermoplastic, such as polyethylene or polypropylene, with a wall thickness of about 4.5 mm (about 0.18 inches). In other embodiments, alternative plastic materials, dimensions, or molding techniques may be used.

Referring back to the embodiment of FIGS. 1 and 2, riser 20 has a lengthwise central axis L, around which is centered a wall 30 that generally has the shape of a truncated hollow cone. The wall of riser 20 has opposing ends 22, 32. End 22 has a larger diameter than does smaller end 32. In an embodiment, wall 30 is inclined at an about 7 degree angle to the lengthwise axis L, but other angles in the range 5-20 degrees may also be used.

Figure 5:
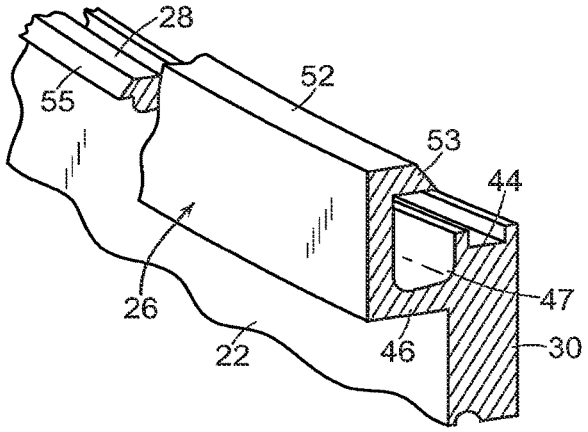
FIG. 5 is another perspective view of a portion of the large end of the riser in FIG. 3.
Figure 6:
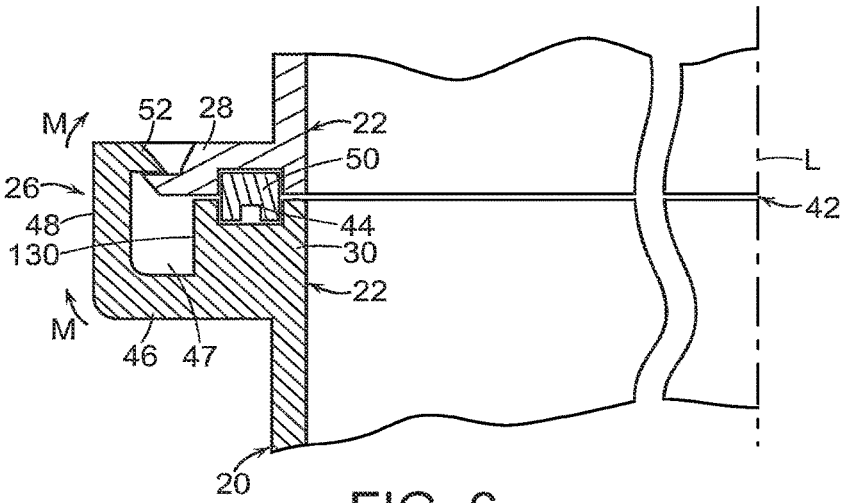
FIG. 6 is a vertical cross section through the large-end joint region of the riser assembly of FIG. 1.

As best seen in FIGS. 1, 2 and 5, the larger end 22 of a riser 20 is characterized by a plurality of tabs 26 which are circumferentially spaced apart by rim segments 28. Rim segments may be referred to as simply "rims" hereafter. The tabs extend in the lengthwise direction from the exterior surface of the wall of the riser. Each tab has a lip 52, for latching onto the rim segment 28 of a mated like riser. The inner edges of the lips 52 are disposed around a circle. The outer edges of the rim segments are disposed around a circle which is congruent with the circle of the lip edges. A joint 42 between risers is formed when the plurality of tabs 26 of one riser are engaged with a plurality of rims 28 of a mating riser. Likewise, joints 142 are formed between mated riser smaller ends as shown in the cross sections at joint locations in FIG. 3. FIG. 6 shows an added gasket 50 captured in a circumferential channel 44 that is associated with joint 42. Gaskets may also be included in joints 142.

FIG. 3 shows an optional step 53 in the wall 30 proximate the small end of riser 20C. This step is discussed below in connection with a safety grating which optionally rests on the step.

Figure 7:
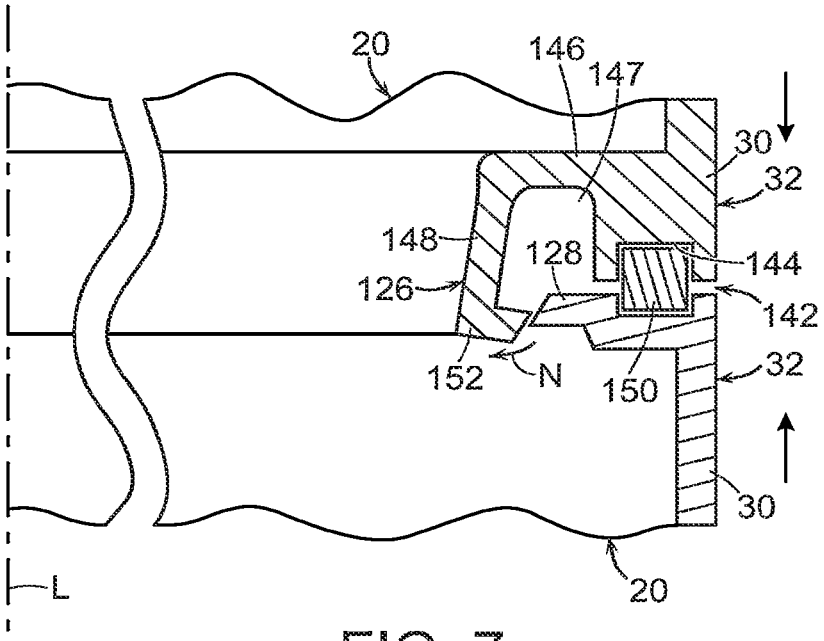
FIG. 7 is a vertical cross section through the small-end joint region of the riser assembly of FIG. 1.

Referring to FIGS. 1, 2, and 7, the smaller end 32 of a riser 20 has many similarities with larger end 22, but also some differences. Smaller end 32 may include a plurality of tabs 36 which are circumferentially spaced apart by rim segments 38, which may be referred to simply as rims hereafter. Joint 142 is formed when the plurality of tabs 36 are engaged with a plurality of rims 38 of a mating riser. Each tab 36 has an outward facing lip 152. When two risers are mated, each lip 152 engages a rim 128 as shown in the assembly cross section at joint 142 in FIG. 3 and FIG. 7. A gasket 150 may be captured within a circumferential channel 144 at the circumferential end of the wall of each riser, to seal joint 142. See FIG. 7.

When used, gaskets 50 or 150 may be made of a rubber or elastomer material, for example ethylene propylene diene monomer ("EPDM") having a Shore A hardness number of about 30. Optionally, where resistance to water passage through the joint is not important to the user, the risers can be assembled without the use of a gasket, and risers may be constructed without a channel 44. See FIG. 6A, discussed below.

In an embodiment shown in FIGS. 1 and 2, riser 20 has ten tabs 26, 36 at each end. The tabs at one end may be aligned in the lengthwise direction with the tabs at the other end of the riser. In other embodiments of the invention, there may be fewer or more tabs; and there may be a different number of tabs at one end, compared to the other end.

Figure 4:
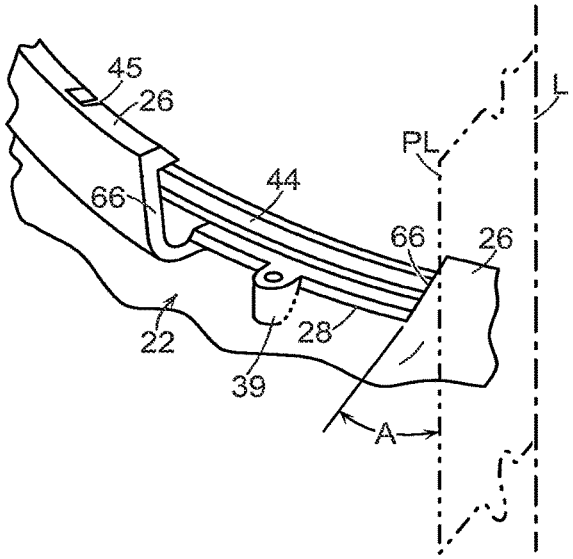
FIG. 4 is perspective view of a portion of the large end of the riser in FIG. 3.

FIGS. 4 to 7 illustrate certain features of the ends of an embodiment of a riser which enhance the convenient making of a good joint with a like riser. (This portion of the description interchangeably applies to the small ends and large ends of risers.) FIG. 4 and FIG. 5 are perspective views of portions of the larger end 22 of riser 20. As shown, each tab 26 has an inward facing lip 53 and that rim 28 runs circumferentially between two spaced apart tabs. Also, each tab 26 has circumferential direction facing ends 66 which are canted at angle A to a lengthwise diametrical plane PL, shown in phantom, within which plane lies lengthwise axis L. The angled ends 66 enable easier engagement of the tabs of two mated risers, as each tab of a first riser nestles into the space between the tabs of the mating second riser, so that each tab engages a rim segment. FIG. 1 shows that in a resultant assembly 18, the angled ends 66 of each tab 26 of a first riser 20 mate/abut the angled ends 76 of spaced apart tabs 36 of the second riser so that interleaved tabs appear continuous around the circumference of the joint 42.

With particular reference to FIG. 5, lip 52 of tab 26 has an inner edge 53 which is angled with respect to the diametrical plane of the riser, so that the tab is thrust elastically outwardly when the lip of the tab first engages with rim 28 of a mating riser. For the same reason, the outer edge 55 of rim 28 is angled with respect to the diametrical plane.

FIG. 6 is a cross section through the riser assembly 18 at joint 42. FIG. 6 shows how the large ends 22 of risers 20 mate. The small ends will mate comparably. FIG. 6 shows lip 52 of tab 26 is engaged with rim 28. Seal 50 may be captured in the groove 44. As pictured in FIG. 6, tab 26 has a body 48, which is the lengthwise extending portion of the tab (i.e., the vertical portion in FIG. 6). Tab body 48 is an arc-shape structure that may run circumferentially, congruently with wall 30 and with the rim segments of the riser. One lengthwise end of tab body 48 may be connected to the exterior wall of riser end 22 by radially inward-running web 46 (which is a horizontal section shown in FIG. 6). The other lengthwise end of the tab body extends beyond the end of the wall where the joint 42 is formed. As described in more detail below, in an embodiment of an injection molded riser, the web 46 may be discontinuous in the circumferential direction.

The combination of elements 48, 46 and local portion 130 of wall 30 defines a circumferentially-running channel 47 (which may have a length nominally equal to the tab width). Channel 47 provides several advantages. When force is applied to the risers to separate the risers from each other at the joint 42, a bending moment (represented by the curved vectors M) is created in web 46. That moment has the effect of thrusting section 48 and lip 52 radially inwardly, toward the central axis L of the riser, to better engage rim 28. That inward radial movement enhances the resistance of the joint to separation compared to the resistance which the assembly would have if channel 47 and section 46 were not present, i.e., compared to the structure shown in FIG. 6A. Secondly, by increasing the effective length of the tab body, even without the foregoing phenomenon, deflection of tabs by contact with rim segments, and thus engagement of mating parts, is made easier.

Figure 6A:
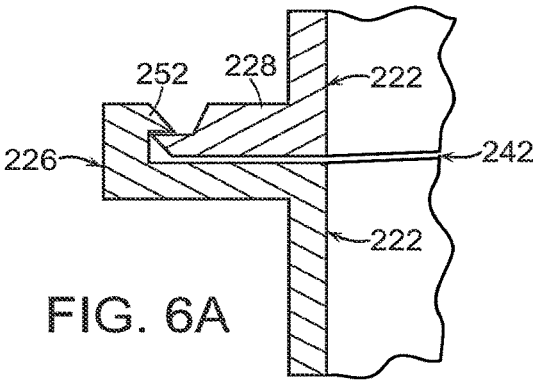
FIG. 6A is a view like FIG. 6 showing a joint which lacks a seal and a channel between the wall and latching tab.

FIG. 6A shows two mated risers 222 and illustrates an alternate embodiment of the invention. One of a plurality of tabs 226 and rim segments 228 is shown. Joint 242 is formed between two mated risers 222 when lip 252 of tab 226 engages rim segment 228. First, the risers 222 lack any optional circumscribing channel for a seal between the mating parts. Second, there is no channel like channel 47 that spaces the tab body away from the end of the wall, as there is in the embodiment shown in FIG. 6. See also FIG. 11 and related discussion, where the tab body is also not spaced apart, but is a lengthwise continuation of a portion of the wall.

FIG. 7 is a cross section through the riser assembly 18 at joint 142, showing how the small ends 32 of risers 20 mate. The ends are shown as they are being moved toward each other to their final joined-together configuration, as indicated by the vertical arrows. Tab 126 has a construction like tab 26. Lip 152 is at the end of tab body 148, which is connected to web 146 that extends radially from the wall 30 of riser 20 at small end 32. (As mentioned, lip 152 faces outwardly from the center of the riser, which compares with inward-facing lip 52 of tab 26.) In FIG. 7, the engagement of lip 152 with rim 128 and movement of the risers toward each other causes lip 152 to be deflected radially inwardly as indicated by arrow N. This action is facilitated by the angled terminal ends of lip 152 and rim 128, previously discussed.

Once the mating features of the ends are engaged, the risers cannot conveniently be separated other than by use of tools which pull all tabs from engagement with the mating rims. It is not expected that a user will often seek to separate the risers once they are joined to each other.

Referring again to FIG. 4, each of the plurality of rim segments 28 may be interrupted by a boss 39, which is nominally in the center of the rim segment. Boss 39 is shaped so it can receive a screw, thus enabling the end of the riser to be fitted with a screw-attached lid. When boss 39 is present, a notch 45 may be present in the lip of the tab 26 which is shaped to engage the rim segment, to accommodate the boss 39 and screw.

Figure 8:
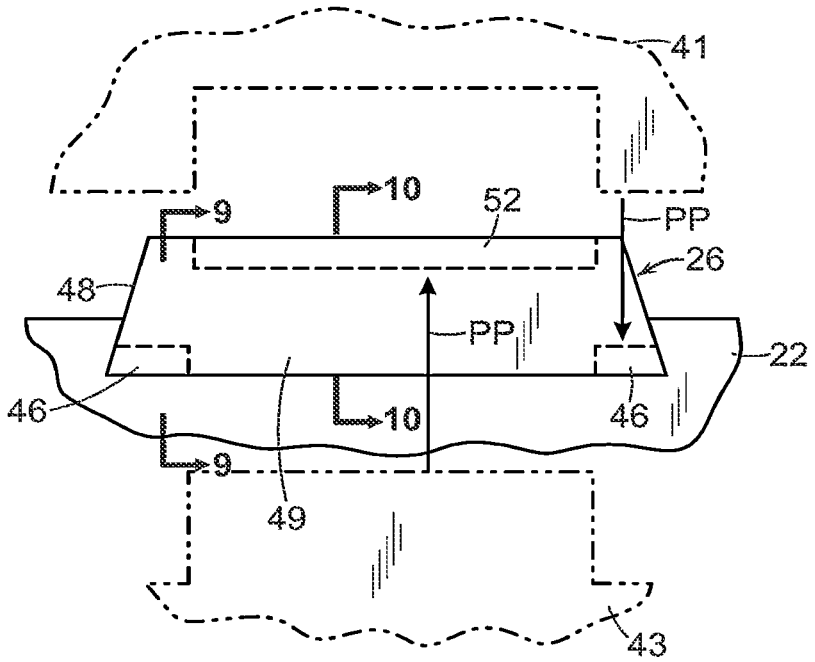
FIG. 8 is a side view of the end of a riser showing a latching tab and (in phantom) portions of tooling which enables the riser to be injection molded.
Figure 9:
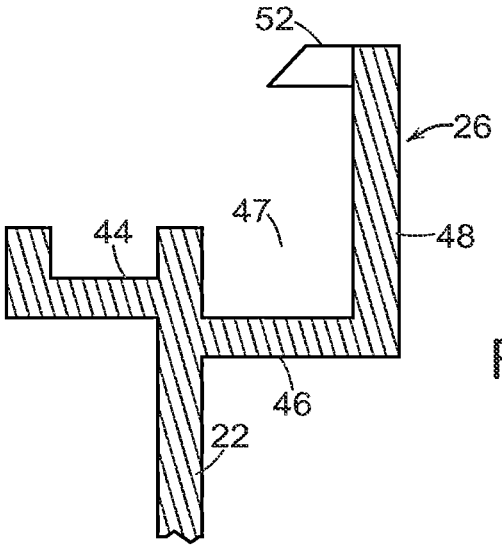
FIG. 9 is a vertical plane cross section through the structure of FIG. 8, near the end of the tab.
Figure 10:
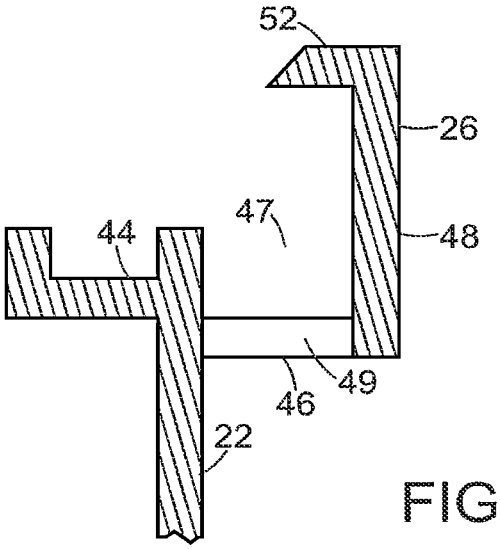
FIG. 10 is a vertical plane cross section through the structure of FIG. 8, near the middle of the tab.

FIG. 8-10 show in more detail other aspects of a tab of an embodiment of an injection molded riser 20. The tab may be mated to the wall of the riser by a web 46 that is comprised of two spaced apart portions, which facilitates manufacture. FIG. 8 is a side view of a portion of the end 22 of a riser showing tab 26. FIG. 9 and FIG. 10 are vertical plane portions through the tab and riser end shown in FIG. 8. Also shown in FIG. 8, in phantom, are mold parts 41, 43 in their spaced apart (or "open mold") condition. The arrows PP show how the mold parts 41, 43 move toward each other when the mold is closed so plastic can be injected into the mold.

With reference to FIG. 8, 9, 10, there is a space 49 between the two circumferentially spaced-apart portions of web 46. Space 49 is created by mold part 43. When the tab has the configuration which comprises space 49 that enables mold part 43 to create the underside surface of lip 52. An alternative embodiment of tab may have a web 46 which is continuous from one circumferential edge of the tab to the other. In such case, a more complex mold may be necessary for efficient injection molding.

Figure 11:
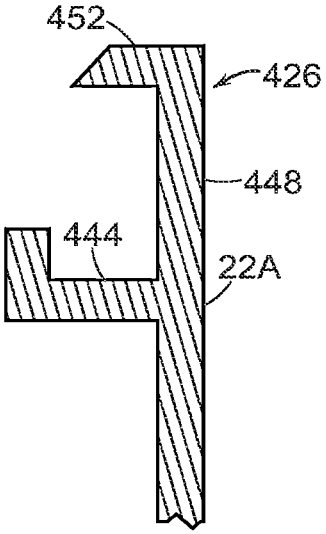
FIG. 11 is a view like FIG. 9, showing an alternative embodiment of tab where the tab is not spaced apart from the wall at the end of the riser.

FIG. 11 is a view like FIG. 9, showing an alternative embodiment tab 426 at the large end of a riser. There is no channel like channel 47. Tab body 448 is a continuation of a portion of the riser wall. Lip 452 overhangs the channel 444 within which a seal will be placed prior to a joint between risers being made.

The next paragraphs describe a safety grating that is particularly useful with the foregoing kinds of conical risers which have different diameter ends, compared to known safety gratings which are used with more or less constant diameter risers of the prior art.

Figure 12:
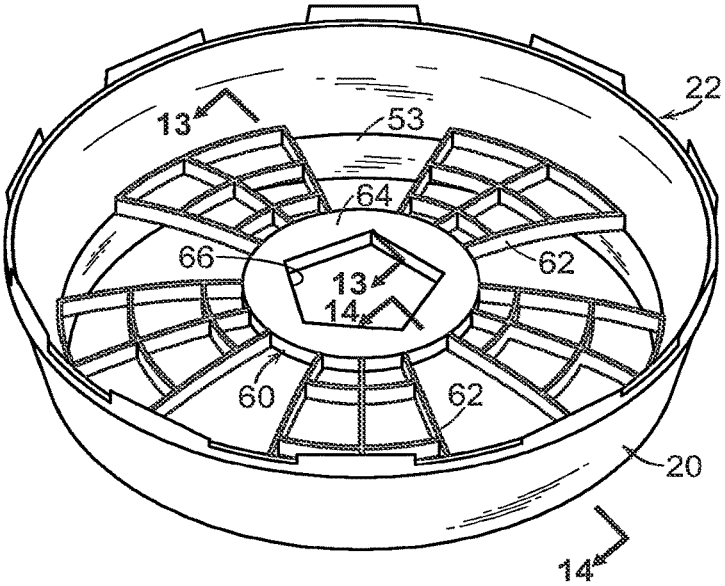
FIG. 12 is a perspective view of a riser with a safety grating positioned within the bore of the riser.
Figure 14:
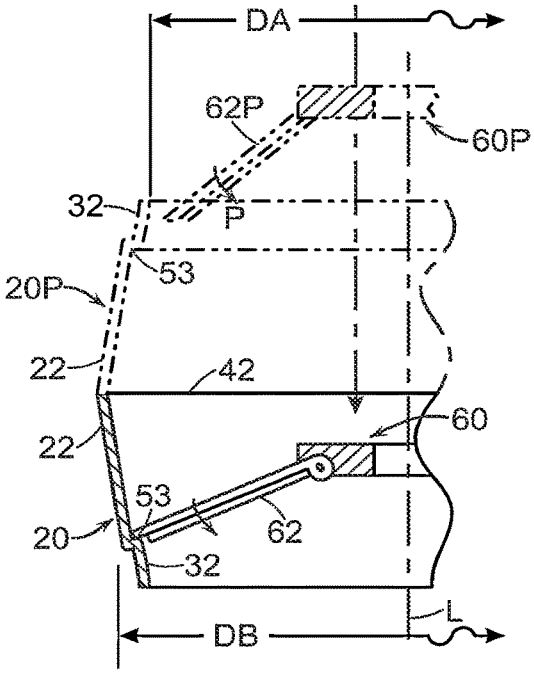
FIG. 14 is a partial vertical cross section of the assembly of FIG. 12, showing in phantom an additional riser, along with the grating as it was being inserted into the riser assembly from the top.
Figure 13:
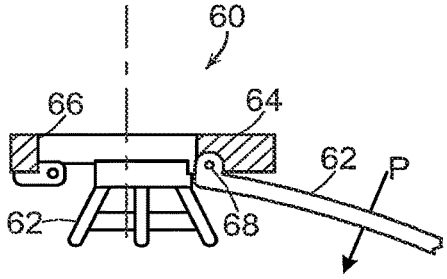
FIG. 13 is a partial vertical cross section of the grating shown in FIG. 12.

FIG. 12 is a perspective view, looking down on the larger end 22 of riser 20. Grating 60 is set within the bore of the riser. FIG. 13 is a side elevation view of a portion of the grating 60 (also referred to as a grate). Grating 60, which in an embodiment may be made of plastic like that of the associated riser, may include a hub 64 having a pentagonal opening 67. The first ends of five lattice-like arms 62 may be attached to the hub at hinge points 68 and extend generally radially outwardly from the hub. The free or outer ends of the arms may be in contact with circumferential step 53 on the interior wall of riser 20, near the small end 32 of the riser. See FIG. 3 and FIG. 12. FIG. 14 is a partial vertical cross section of the grating and riser assembly shown in FIG. 12. The length of the arms 62 and size of hub 64 are such that, as shown by FIG. 14, the grate, in riser lengthwise cross section view, has a cross section which is substantially in the shape of an arch. Thus, any vertical load placed on the grate (such a child, pet, or other object entering the open top of the riser assembly) may be substantially resisted by the grate and hindered from moving further downward. The ends of the legs are constrained from outward and downward movement by the riser wall circumferential and vertical structure.

Arms 62 may be hinged. The hinging enables placement of a grating by passing the grating through the small end of a riser, for example, the small end of riser 20P which has a diameter DA of the opening of an imaginary cylinder, as shown in phantom in FIG. 14. The arms 62 hinge inwardly, as indicated by arrow P in FIG. 14 for arm 62P of riser 60P, both shown in phantom, as the grating is being inserted into the riser assembly. The hinging makes the effective outside diameter of the grating smaller than the diameter DB which the grating has when in its working position. Effective outside diameter refers to the diameter of the smallest imaginary short cylinder through which a grating may be passed lengthwise.

Referring again to FIG. 1, it can be appreciated that hinging may be necessary to position a grating within the lowermost riser 20 of assembly 18 when the grating is lowered from the top, in contrast to prior art grating having an unchangeable effective outside diameter. Grating 60 may be used on risers other than those described herein.

Springs (not shown) may be employed to bias the arms in the outward, or most-extended, direction. For example, a torsion spring may be put around the pin of the hinge joint, when the hinge joint has appropriate construction. For example, compressible elastic bumpers may be used to resist the inward or collapsing motion of the arms. Likewise, the movement of one arm may be interlocked with the movement of adjacent arms, so all arms move radially outward or inward in coordination. The interlocking may be on the nature of a flexible tang which is fixed to one arm and extends in the circumferential direction, from the one arm to engage slidingly a surface of an adjacent second arm.

An alternative embodiment grating may have one or more arms which are not hinged in combination with at least one, or more than one, arm which is hinged. In some embodiments, hinged arms may need only be in number sufficient to decrease the effective outside diameter of the grating, so that such effective diameter is smaller than the small end opening of a riser like riser 20 (or the opening of an imaginary cylinder associated with the small end opening), with which the grating is used. Thus, there may be an embodiment which has only one hinged arm.

Figure 15:
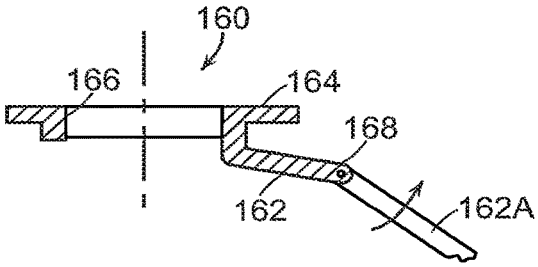
FIG. 15 is a view like FIG. 13, showing an alternative embodiment grating.

In still another alternative embodiment of grating, illustrated by FIG. 15, the hub 164 of grating 160, having a bore 167, has at least one, and preferably a multiplicity, of fixed arm portions 162, each of which has a movable arm portion 162A. The portion 162A is attached to the portion 162 at hinge point 168, which is radially outward from the point where the arm portion 162 connects to the hub.

In other embodiments, a grating may have a number of arms which may be different from five arms of exemplary grating 60. For example, 3, 4, or 6 or more arms may be used. And although a correlation between the number of polygon sides of the center opening with the number of arms is used in some embodiments, (i.e., pentagonal for five arms, hexagonal for six arms, etc.), in alternative embodiments the shape of the center opening may be uncorrelated with the number or arms. In further alternative embodiments, the opening may be round or there may be no opening. When an opening is present, the opening may be sized to allow passage of a hose line, but not a child's body, to facilitate pumping out of the septic tank without removal of the grate.

The following paragraphs describe adapters which are particularly useful with the foregoing kinds of risers which have tapered walls, also referred to as conical walls.

Figure 16:
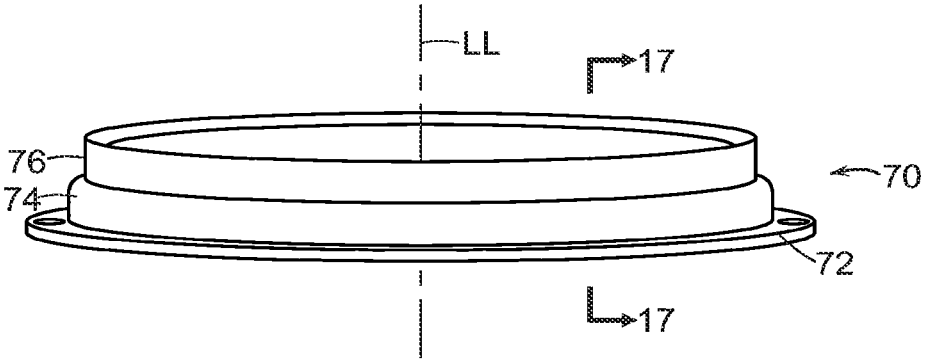
FIG. 16 is a perspective view of an adapter for connecting a riser to the top of a septic tank or to the end of a piece of pipe.
Figure 17:
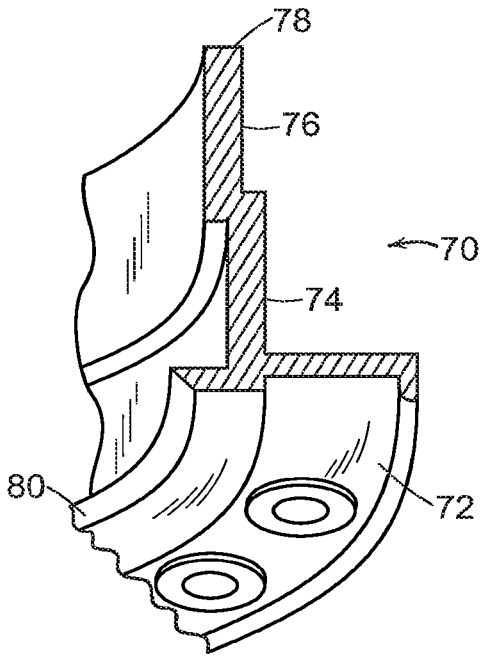
FIG. 17 shows a portion of the adapter of FIG. 17 in partial vertical cross section.

FIG. 16 shows in perspective an exemplary adapter 70 having lengthwise central axis LL, and FIG. 17 is a partial cross section of the adapter 70. Adapter 70 may (a) enable attachment of the small end of a riser of the present invention to the top of a tank, such as a septic tank; (b) enable attachment of a corrugated pipe or prior art riser or other future riser to the top of a tank; and/or (c) enable a riser of the present invention to be attached to the end of a corrugated pipe or to a prior art riser, or vice versa.

In an embodiment, adapter 70 may have a first larger end comprising flange 72, and has a second end 78 comprising cylindrical section 76 which has a diameter smaller than the outside diameter of adapter flange 72. An intermediate size section 74 connects the section 76 with the flange. Within the bore of the first end flange is inward projecting ledge 80. Ledge 80 may have an inside diameter and other dimension which preferably corresponds with the effective diameter of the rims 128 at the smaller end 32 of a riser 20.

Figure 18:
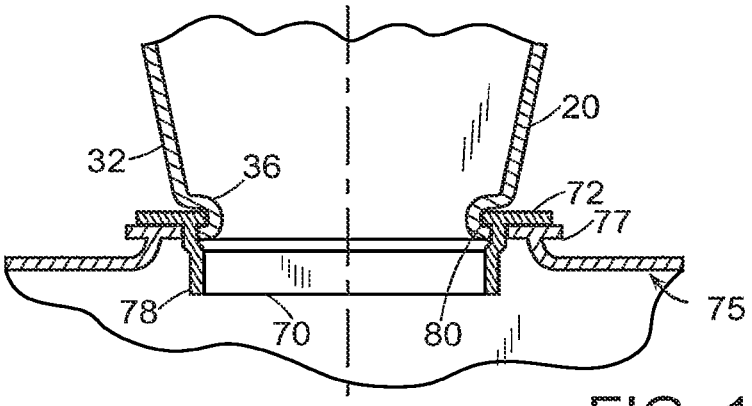
FIG. 18 is a partial cross section showing how a taper wall riser is connected to the top of a septic tank by means of an adapter of FIG. 16.

When a septic tank has an opening with a top flange that has a suitable inward extending rim, the small end of a riser 20 can be snapped onto the tank top flange, and the tabs will latch onto the rim. When the tank does not have such a suitable top flange, as illustrated by flange 77 of tank 75, the adapter flange 72 can be screwed or otherwise attached to the flange 77, as shown in the partial vertical cross section of FIG. 18. In FIG. 18, tabs 36 of riser 20 are shown after they have been engaged with ledge 80 of the adapter.

Figure 19:
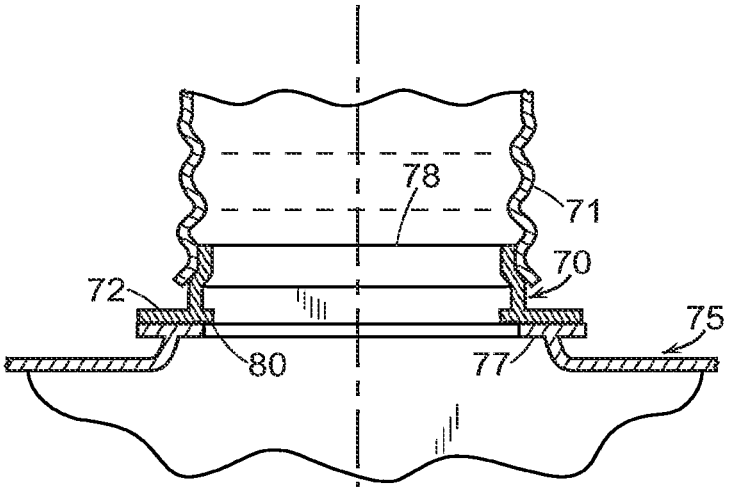
FIG. 19 is a partial cross section showing how a piece of pipe is connected to the top of a septic tank by means of an adapter of FIG. 16.

FIG. 19 shows how the adapter 70 can be used to mount a piece of pipe (or other item having a suitable diameter) on the top of a tank. The small end 78 of adapter 70 faces in the upward direction (away from the interior of the tank 75) and the flange 72 is screwed or otherwise attached to the rim 77 at the septic tank opening. A corrugated pipe 71 is shown mounted on the section 76 at the small end 78 of the adapter; alternatively, the pipe fits the intermediate section 74.

Figure 20:
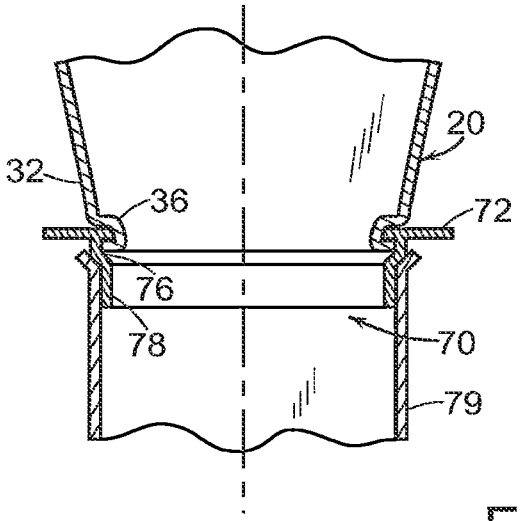
FIG. 20 is a partial cross section showing how a taper wall riser is connected to the end of a piece of pipe by means of an adapter of FIG. 16.

It is sometimes desired replace a portion of a prior art riser that is spaced apart from the tank, or to add to the length of a prior art riser. FIG. 20 shows how the small end 78 of adapter 70 may be inserted into the top of a riser 79 that does not have an end that mates with a riser of the present invention. Adhesive and or radially-running screws may be used to fasten adapter 70 to the original in-place riser 79. Then riser 20 may be inserted into the opening of flange 72 and the tabs at the small end 32 of the riser become engaged with the ledge 80 of the adapter.

Figure 21:
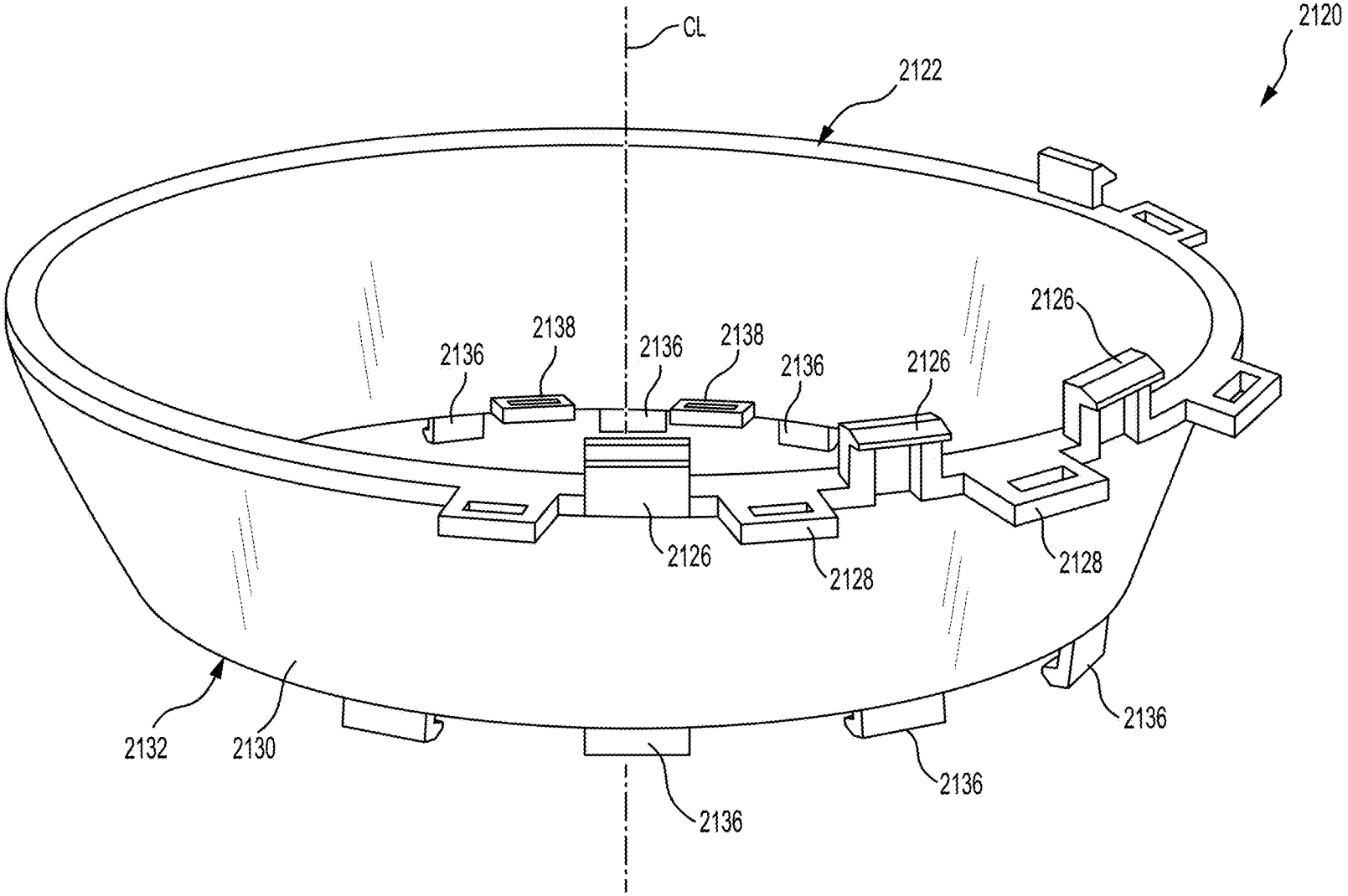
FIG. 21 is a perspective view of another embodiment of a riser having radially deflecting latches.
Figure 22:
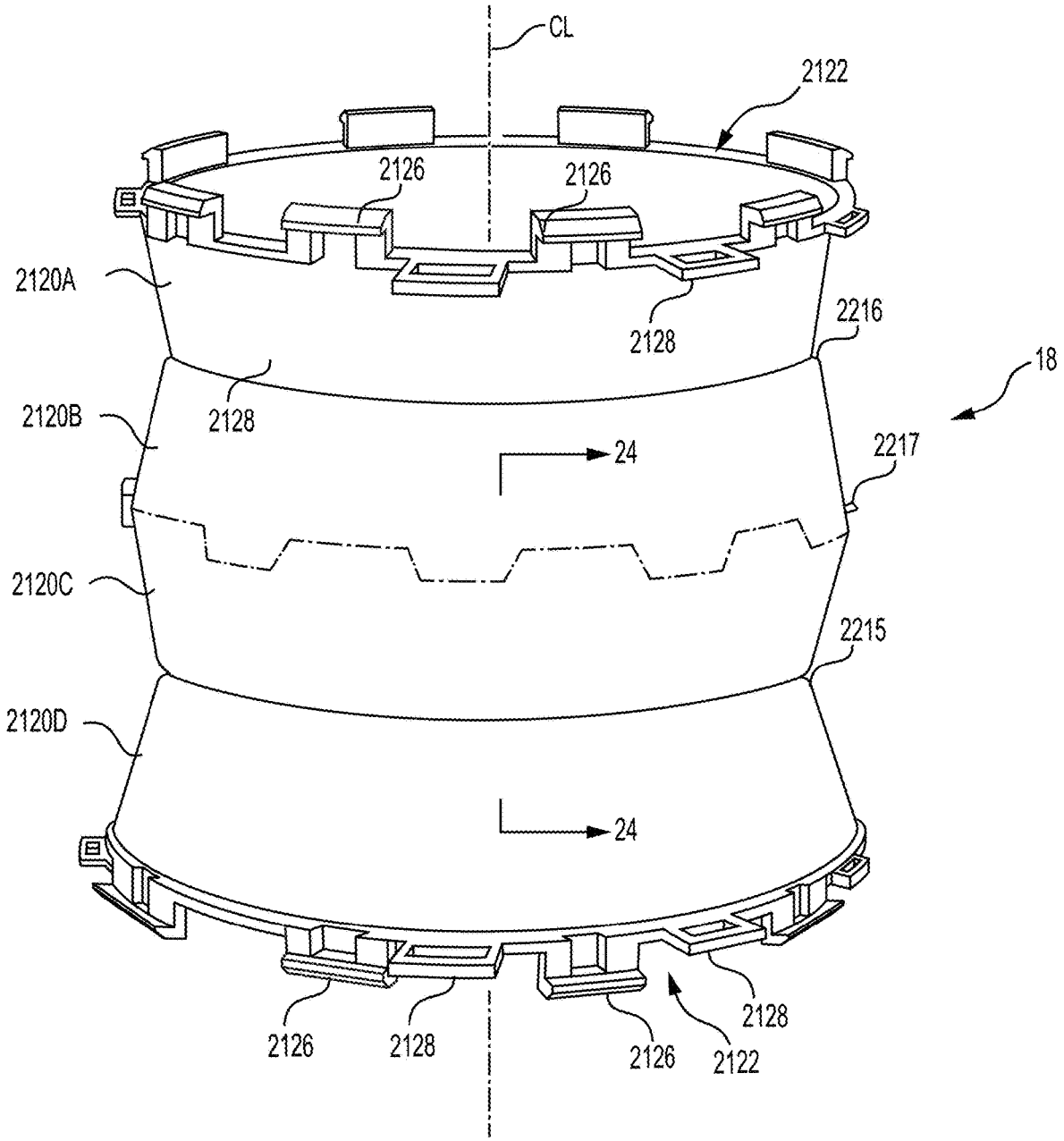
FIG. 22 is a perspective view of a riser assembly comprised of risers depicted in FIG. 21.

FIG. 21 depicts another embodiment of a riser, riser 2120, with alternative components for forming joints between multiple riser pieces. FIG. 22 is an elevation perspective view showing four identical risers 2120A, 2120B, 2120C, and 2120D that are joined to each other as riser assembly 18. The small end of riser 2120B mates with the small end of riser 2120A at joint 2216. Similarly, the small end of riser 2120C mates with the small end of riser 2120D at joint 2215. The large end of riser 2120B mates with the large end of riser 2120C at joint 2217. The wall of the riser assembly undulates in the lengthwise direction, so the wall is close to the central axis at circumferential joints 2215 or 2216 and distant at circumferential joints 2217.

Referring back to the embodiment of FIG. 21, riser 2120 has a lengthwise central axis CL, around which is centered a wall 2130 that generally has the shape of a truncated hollow cone. The wall of riser 2120 has opposing ends 2122 and 2132. End 2122 has a larger diameter than does smaller end 2132. In an embodiment, wall 2130 is inclined at an about 7-degree angle to the lengthwise central axis CL, but other angles in the range of 5-20 degrees may also be used. Joints may be formed by combining latches from one riser to receivers of another riser. FIG. 21 depicts multiple radially deflecting latches 2126 positioned around the large end 2122 of riser 2120. Similar latches 2136 are positioned around the small end 2132 of riser 2120. Radially deflecting latches, 2126, 2136 may be placed equidistantly around the circumference of ends 2122 or 2132 as shown in FIG. 22, though in other embodiments, irregular placement of latches and receivers may be used (FIG. 21 omits latches and receivers around the entire perimeter of surface 2122 and 2130 for clarity). When joining two riser sections, radially deflecting latch 2136 may interface with a receiver, such as receiver 2128 or 2138 on a corresponding riser section to form a joint. Gaskets or seals described in other embodiments may also be used in forming joints with risers 2120, though those gaskets are omitted from the drawings to better illustrate the other joint components.

Figure 23A:
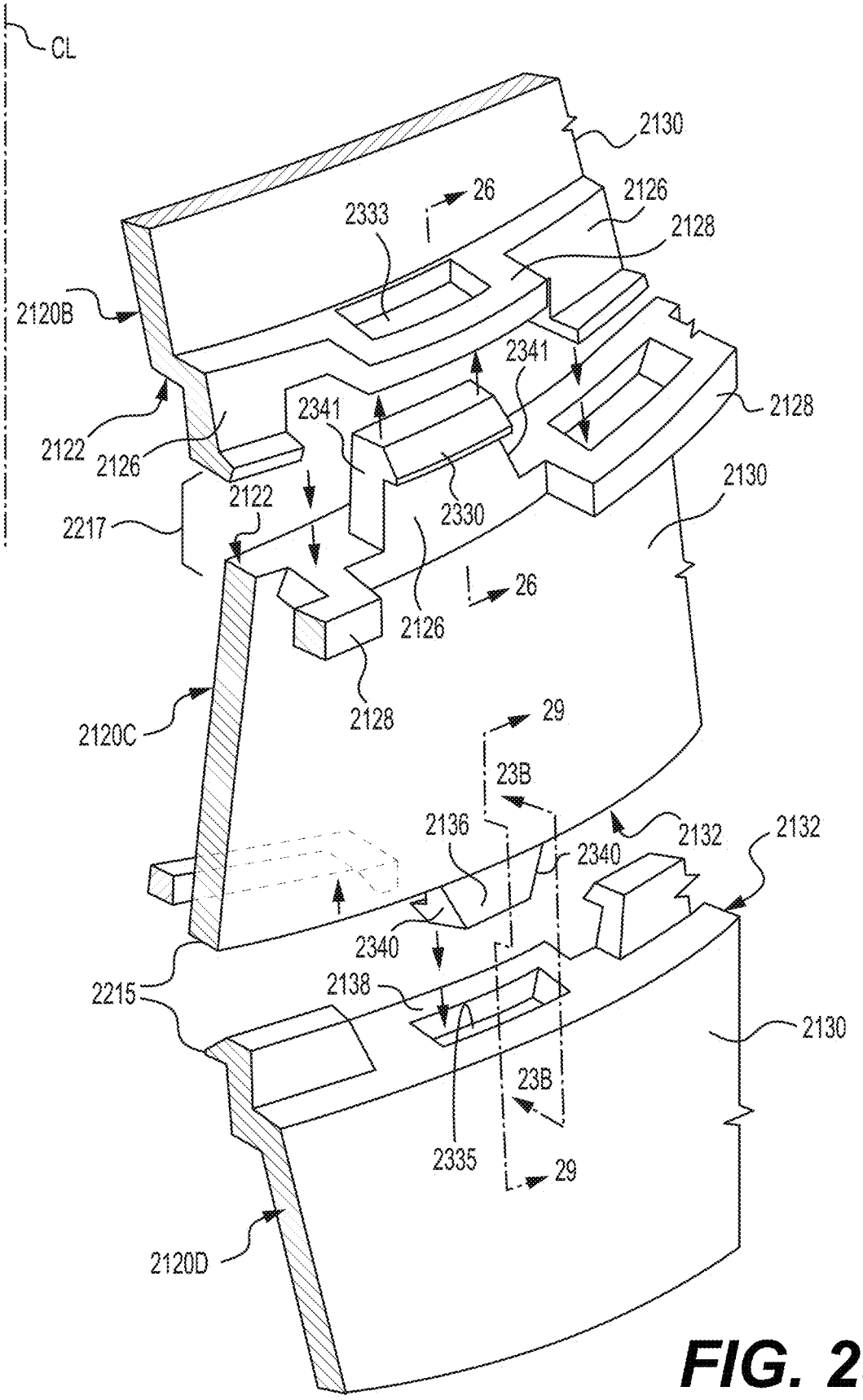
FIG. 23A is a perspective view of a portion of a riser assembly comprising three risers illustrating radially deflecting latches.

FIG. 23A illustrates a portion of a riser assembly having three risers 2120B-D spaced apart with vertical movement arrows showing the connection of riser sections to form joints 2215 and 2217. Joint 2217 may be formed by connecting riser 2120B to riser 2120C, thereby engaging radially deflecting latches 2126 positioned around the perimeters of risers 2120B and 2120C to mate with corresponding receivers 2128. Each latch 2126 may include sides 2341 and a sloped lip 2330. Sides 2341 and sloped lip 2330 may fit into an opening 2333 of receiver 2128. The sloped lip of 2330 deflects inward toward lengthwise central axis CL as the latch 2126 engages with the receiver 2128, and then the latch, being elastically rigid, springs back away from CL once the lip 2330 clears the edge of receiver 2128. Lip 2330 then snaps around the edge of receiver 2128 securing the risers together.

Figure 24:
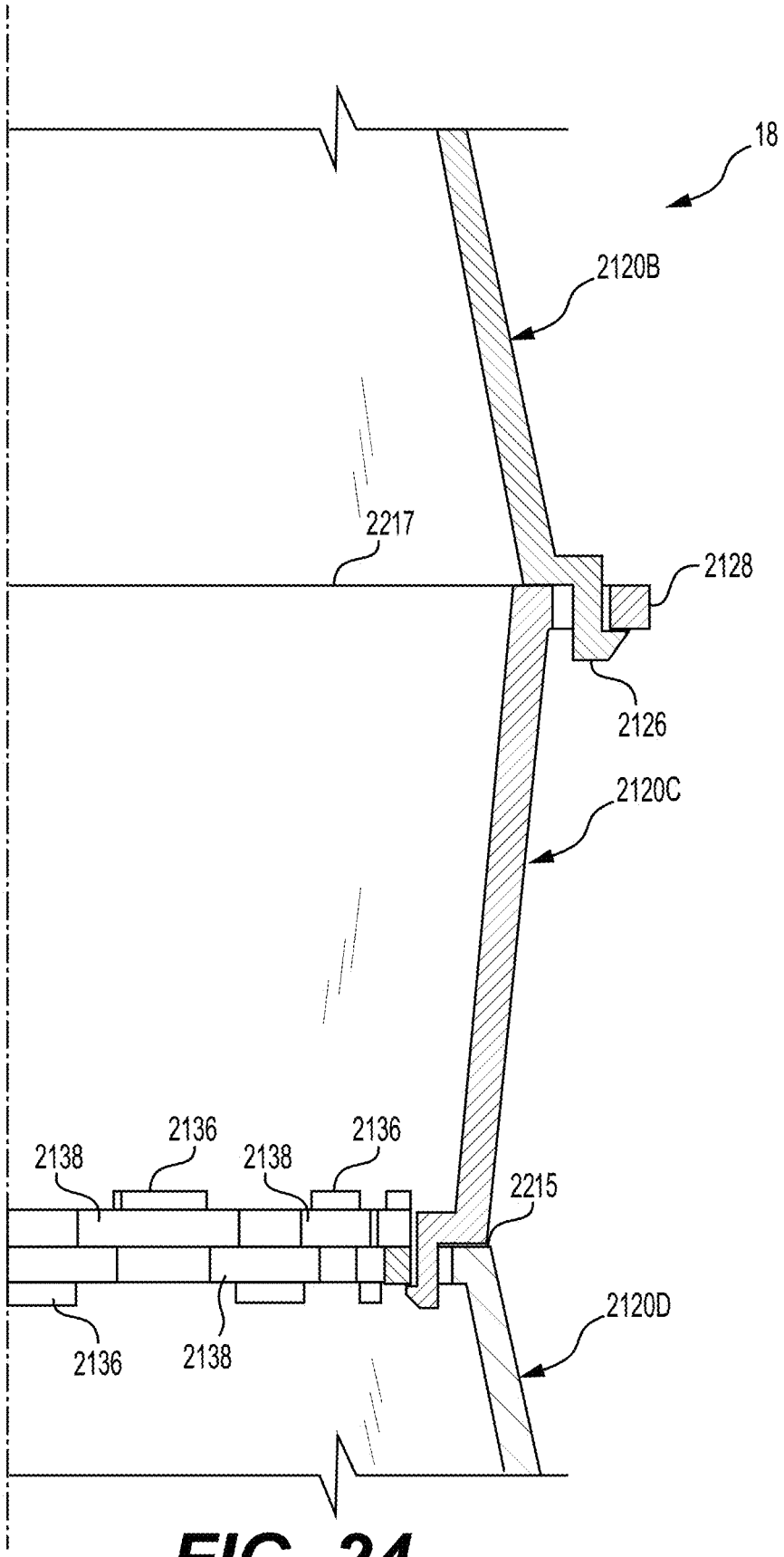
FIG. 24 is a cross section of a riser assembly depicting the connection of three risers with radially deflecting latches.

Latches 2136 and receivers 2138 may form a joint at the smaller joint 2215 in a similar way. Pressing riser 2120C to riser 2120D engages radially deflecting latches 2136 positioned around the perimeters of risers 2120C and 2120D to mate with corresponding receivers 2138. Each latch 2146 may include sides 2340 and a sloped lip (not visible in 23A but corresponding to 2330). Sides 2340 and the sloped lip may fit into an opening 2335 of receiver 2138. The sloped lip is configured to flex inward toward lengthwise central axis CL as the latch 2136 engages with the receiver 2138, and then the latch, being elastically rigid, springs back away from CL once the lip clears the edge of receiver 2138. FIG. 24 illustrates a cross section view depicting both joint 2215, formed by the connection of latches 2136 with receivers 2138, and joint 2217, formed by the connection of latches 2126 with receivers 2128. Latches and receivers of joint 2215, which is formed at the narrow end of risers 2120D and 2120C, are positioned on the interior surface of the riser sections, whereas latches and receivers of joint 2217, which is formed at the larger end of risers 2120C and 2120B, are formed on the exterior of the riser sections.

Figure 23B:
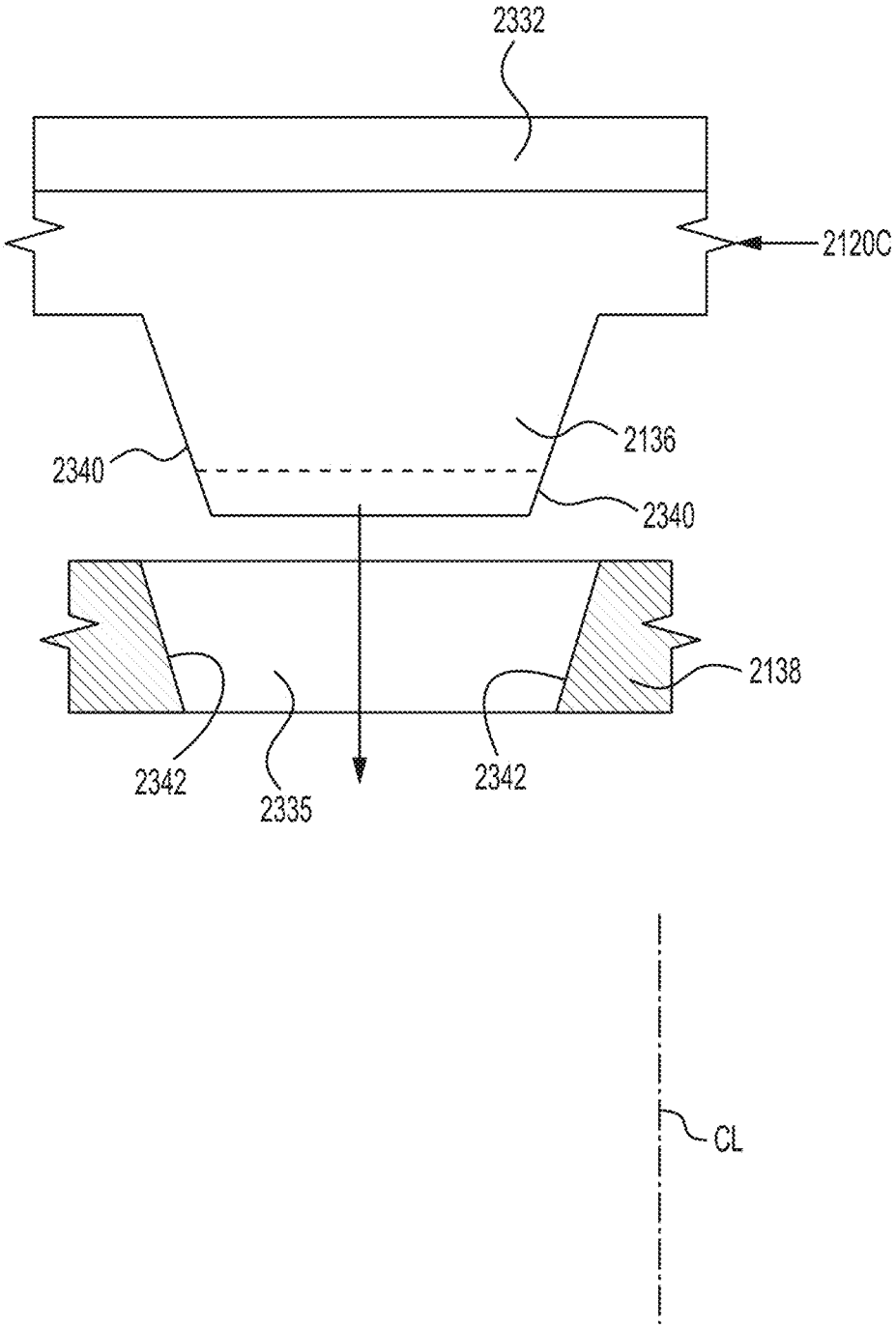
FIG. 23B is an elevation view depicting the interface of a radially deflecting latch between two risers.

FIG. 23B is an elevation view depicting the interface of an embodiment of a radially deflecting latch between two risers. As shown in FIG. 23B, sides 2340 of radially deflecting latch 2136 may be tapered and may correspond with a tapered sloped wall 2342 in opening 2335 of receiver 2138. The tapered edges of walls 2340 and 2342 may aid in guiding latch 2136 into receiver 2138. Though not shown in the figures, the walls 2341 of latch 2126 and the walls of opening 2333 of receiver 2128 may similarly be tapered.

Figure 25:
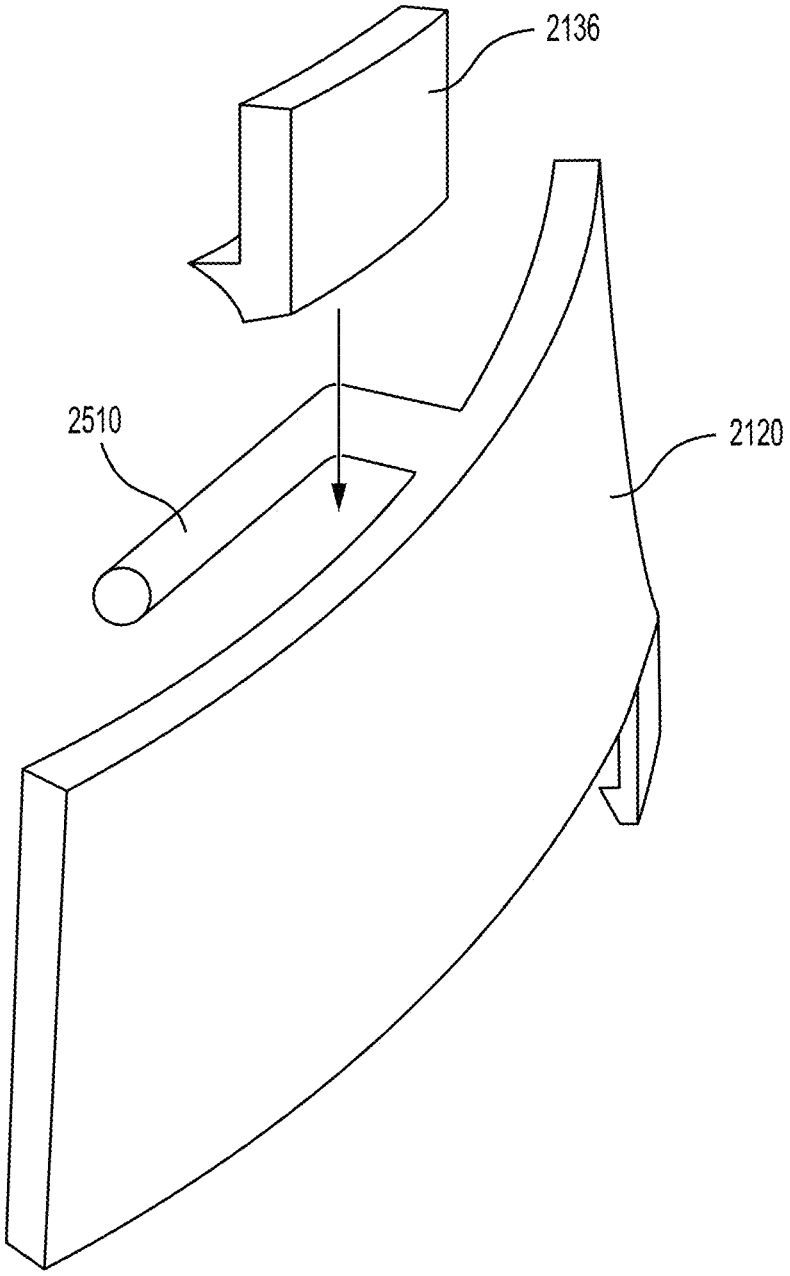
FIG. 25 is a perspective view of an additional embodiment of a radially deflecting latch.

FIG. 25 depicts an alternative embodiment of a receiver, receiver 2510. Receiver 2510 may be open on one end and configured to receive latch 2136. By leaving one end of receiver 2510 open, a riser section may be positioned out of alignment with respect to the orientation of latches and receivers, and the riser section may be twisted or rotated to position the latch 2136 until it abuts the interior edge of receiver 2510. Such flexibility in rotation may simplify the installation of multiple riser sections into a riser assembly.

Figure 26:
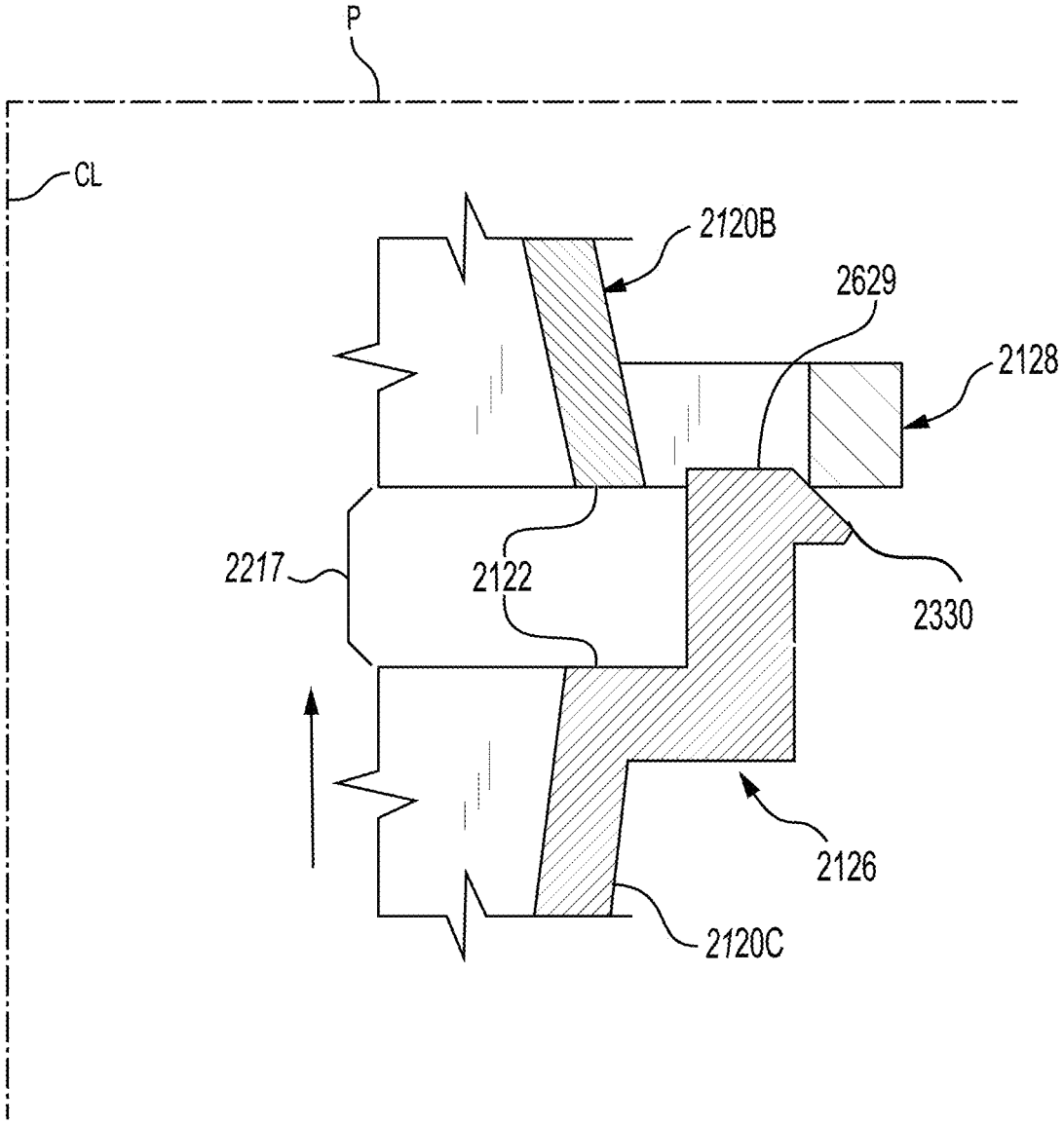
FIG. 26 is a partial cross section view depicting the interface of the radially deflecting latch depicted in FIG. 25 prior to connecting two risers.
Figure 27:
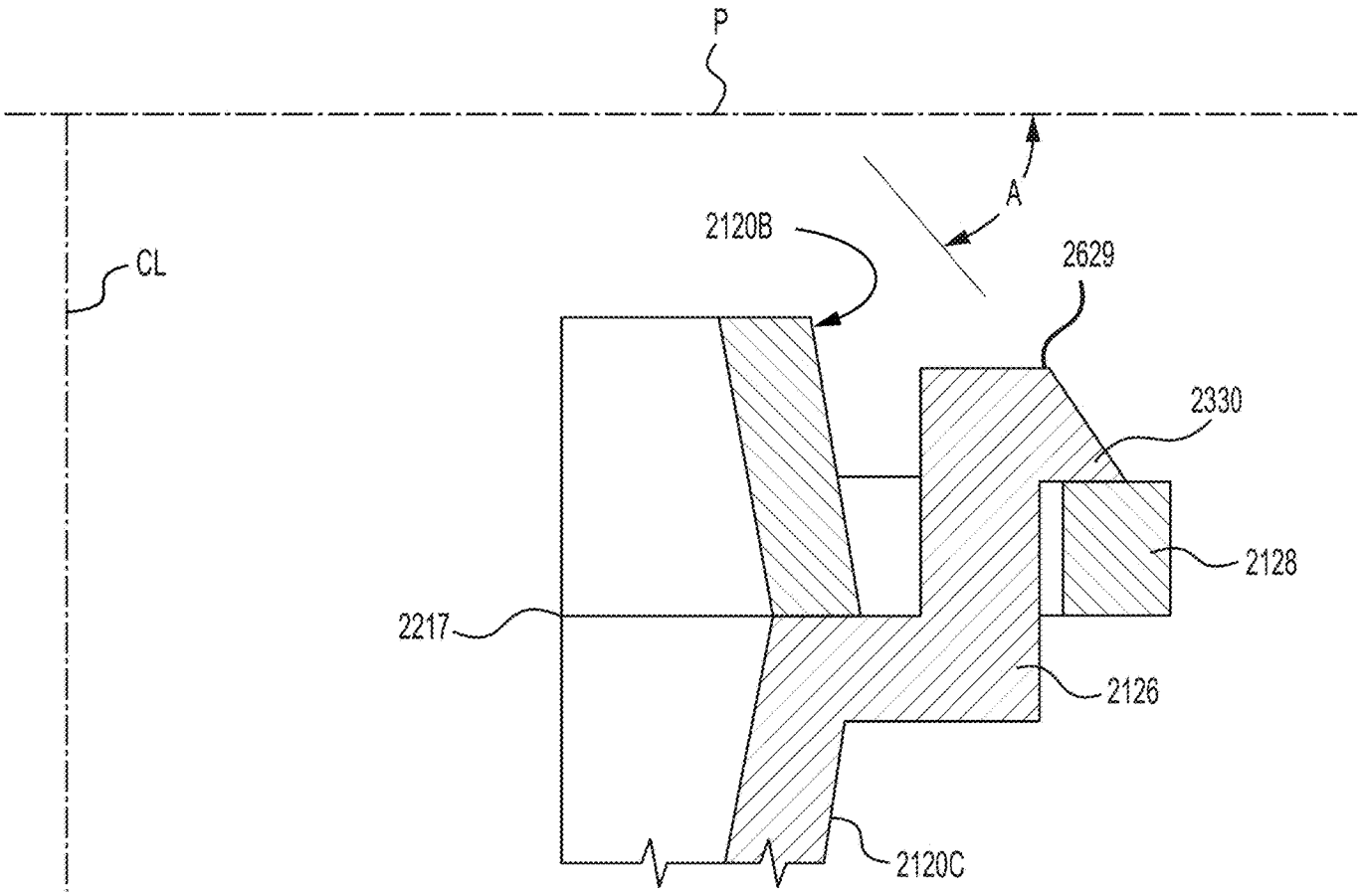
FIG. 27 depicts the cross section view of FIG. 26 after the two risers have been connected and the radially deflecting latch is secured.
Figure 29:
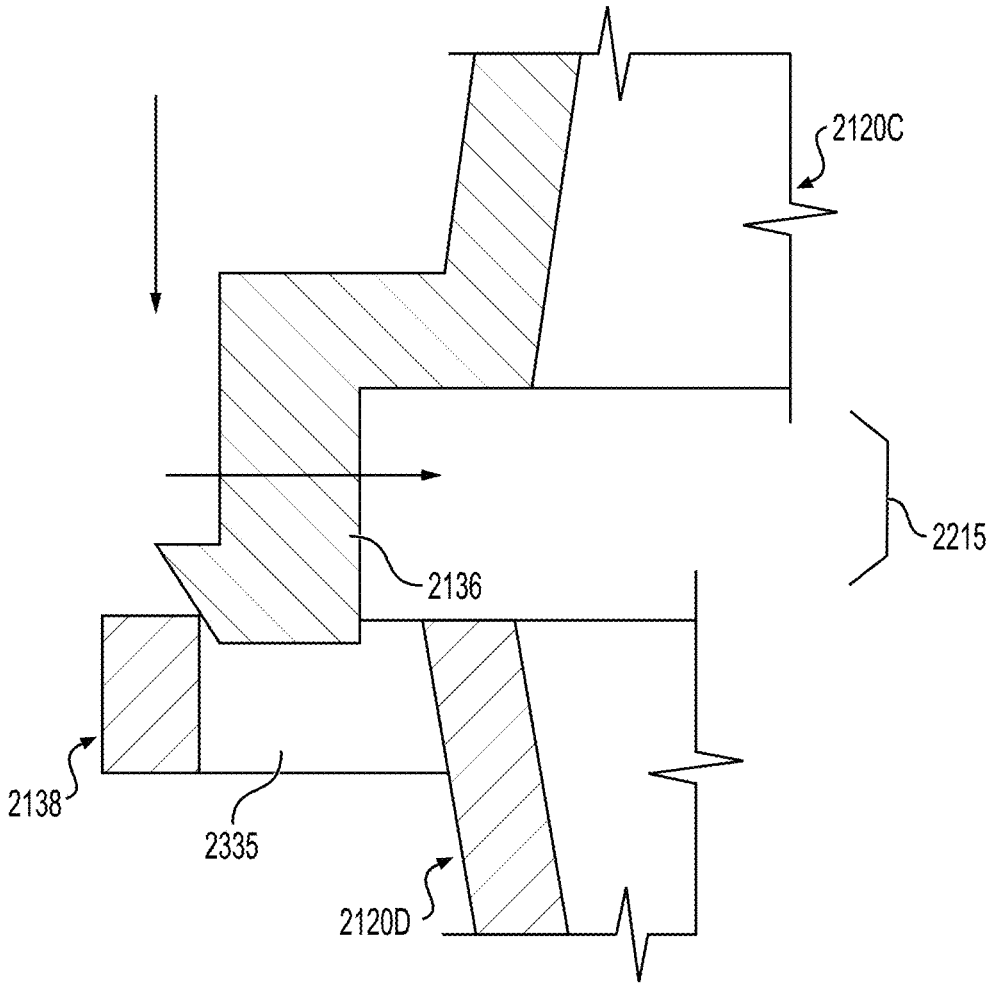
FIG. 29 depicts a section view illustrating the direction of deflection of a radially deflecting latch as two risers are connected together.

FIG. 26 depicts a section view of how joint 2217 may be formed by connecting latch 2126 to receiver 2128. Ends 2122 of each of riser 2120B and 2120C contain corresponding latches 2126 and receivers 2128. As shown in FIG. 26, latch 2126 may include a sloped lip 2330 that abuts a straight portion 2629. When forming the joint, sloped lip 2330 impacts receiver 2128 causing latch 2126 to deflect toward lengthwise central axis CL. FIG. 29 depicts a similar view of a latch 2136 engaging with a receiver 2138 in forming joint 2215. Arrows representing movement are provided which illustrate the direction of the deflection of a latch (i.e., toward the CL of the riser section). FIG. 27 depicts the formation of joint 2217 after the sloped lip 2330 has cleared receiver 2128. In the figure, sloped lip 2330 of latch 2126 has cleared receiver 2128 and snapped away from CL, resting on 2128 which prevents the separation of the latch 2128 from the receiver 2330. Sloped lip 2330 may be formed at an angle "A" from a horizontal plane "P."

Figure 28:
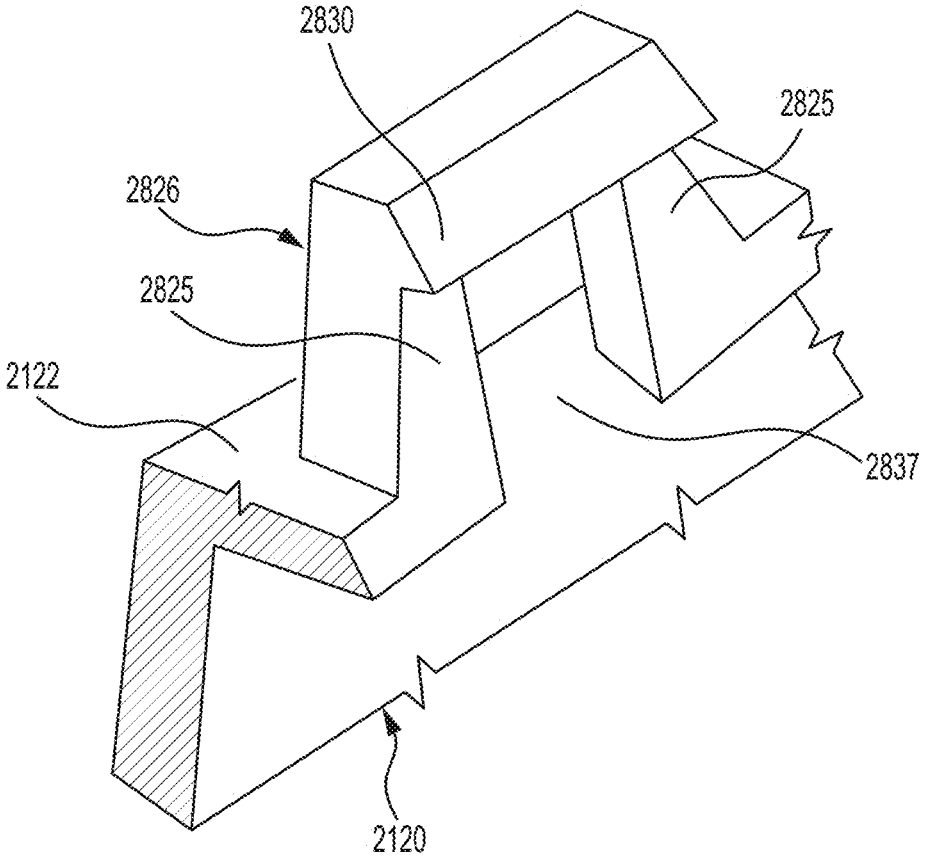
FIG. 28 depicts a perspective view of another embodiment of a radially deflecting latch of a riser.

FIG. 28 illustrates another embodiment of a latch, latch 2826. Latch 2826 may include a cavity 2837 in the surface of the latch. Latch 2826 may include walls 2825 that are tapered as well as sloped lip 2830 for engaging with a receiver. Latch 2826 may improve economy in producing riser sections because it is comprised of less material due to the cavity 2837.

Figure 30:
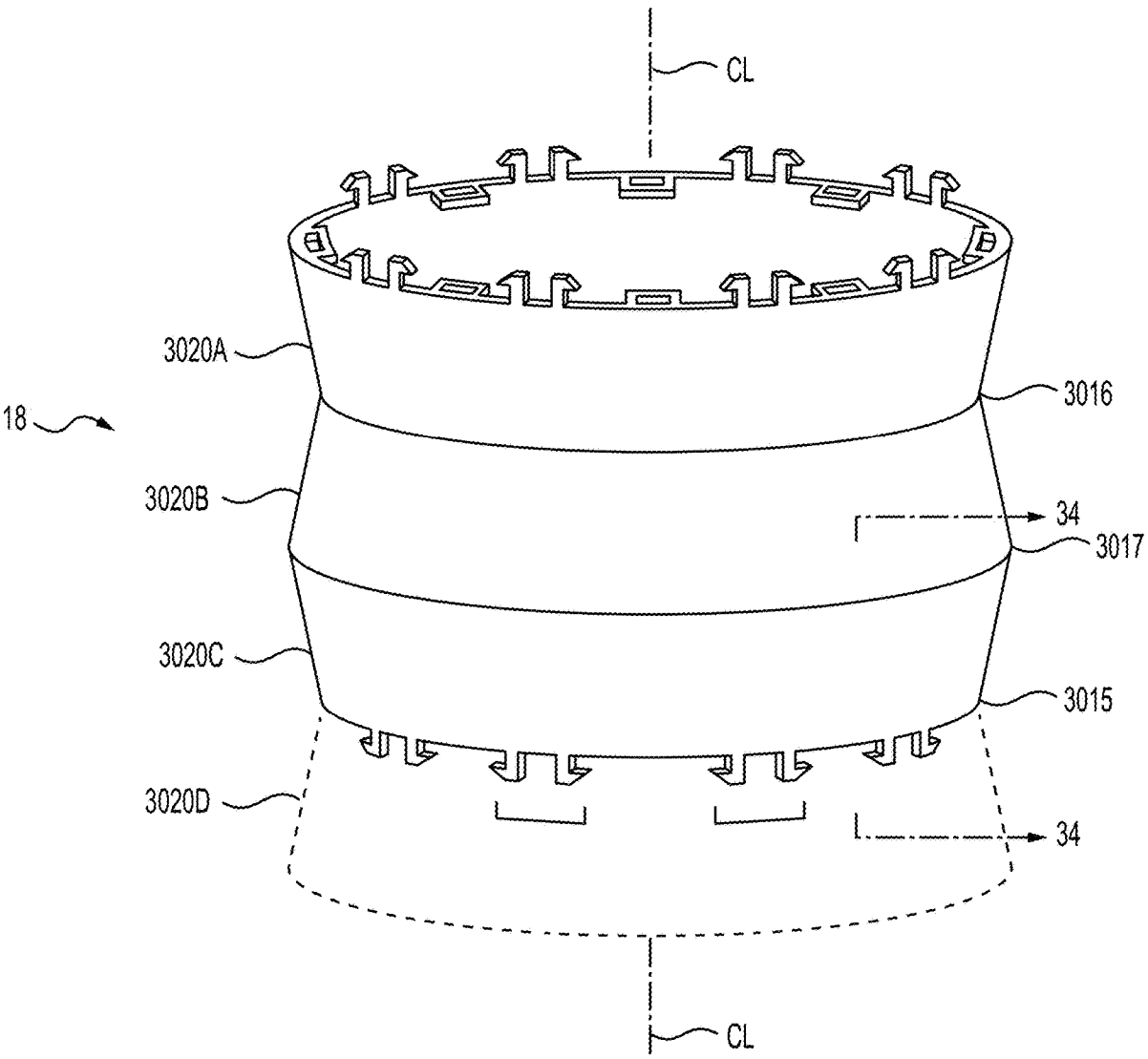
FIG. 30 depicts a perspective view an embodiment of a riser assembly with three risers having circumferentially deflecting latches.

FIG. 30 depicts another riser assembly 18 formed of another embodiment of a riser, riser 3020, (shown in FIG. 30 as risers 3020A-D). Four identical risers 3020A, 3020B, 3020C, and 3020D (shown in phantom) are joined to each other as riser assembly 18. The small end of riser 3020A mates with the small end of riser 3020B at joint 3016. The large end of riser 3020B mates with the large end of riser 3020C at joint 3017. The wall of the riser assembly undulates in the lengthwise direction, so the wall is close to the lengthwise central axis CL at circumferential joints 3015 or 3016 and distant at circumferential joints 3017.

Figure 31:
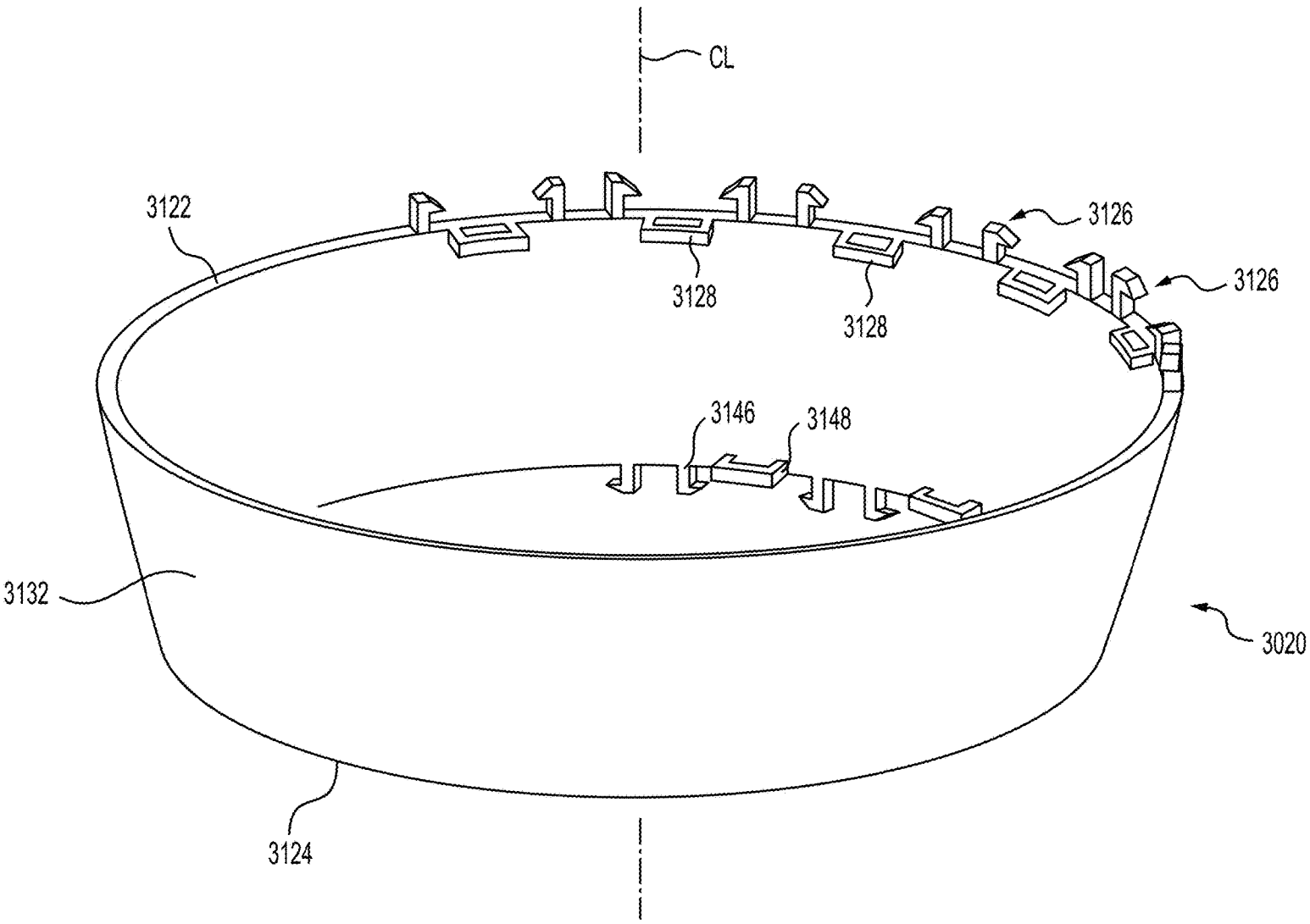
FIG. 31 depicts a perspective view of an embodiment of a riser having circumferentially deflecting latches.

FIG. 31 depicts a perspective view of riser 3020. Riser 3020 has a lengthwise central axis CL, around which is centered a wall 3132 that generally has the shape of a truncated hollow cone. Wall 3132 of riser 3020 has opposing ends 3122 and 3124. End 3122 has a larger diameter than does smaller end 3124. In an embodiment, wall 3132 is inclined at an about 7-degree angle to the lengthwise central axis CL, but other angles in the range of 5-20 degrees may also be used. Joints may be formed by combining latches from one riser to receivers of another riser. FIG. 31 depicts multiple circumferentially deflecting latches 3126 positioned around the large end 3122 of riser 3020. Similar latches 3146 are positioned around the small end 2124 of riser 3020. Radially deflecting latches, 3126 and 3146 may be placed equidistantly around the circumference of ends 3122 or 3132, though in other embodiments, irregular placement of latches and receivers may be used (FIG. 31 omits latches and receivers around the entire perimeter of surface 3122 and 2124 for clarity). When joining two riser sections, radially deflecting latch 3126 may interface with receiver, such as receiver 3128 or 3148 on a corresponding riser section to form a joint. Gaskets or seals described in other embodiments may also be used in forming joints with risers 3020, though those gaskets are omitted from the drawings to better illustrate the other joint components.

Figure 32:
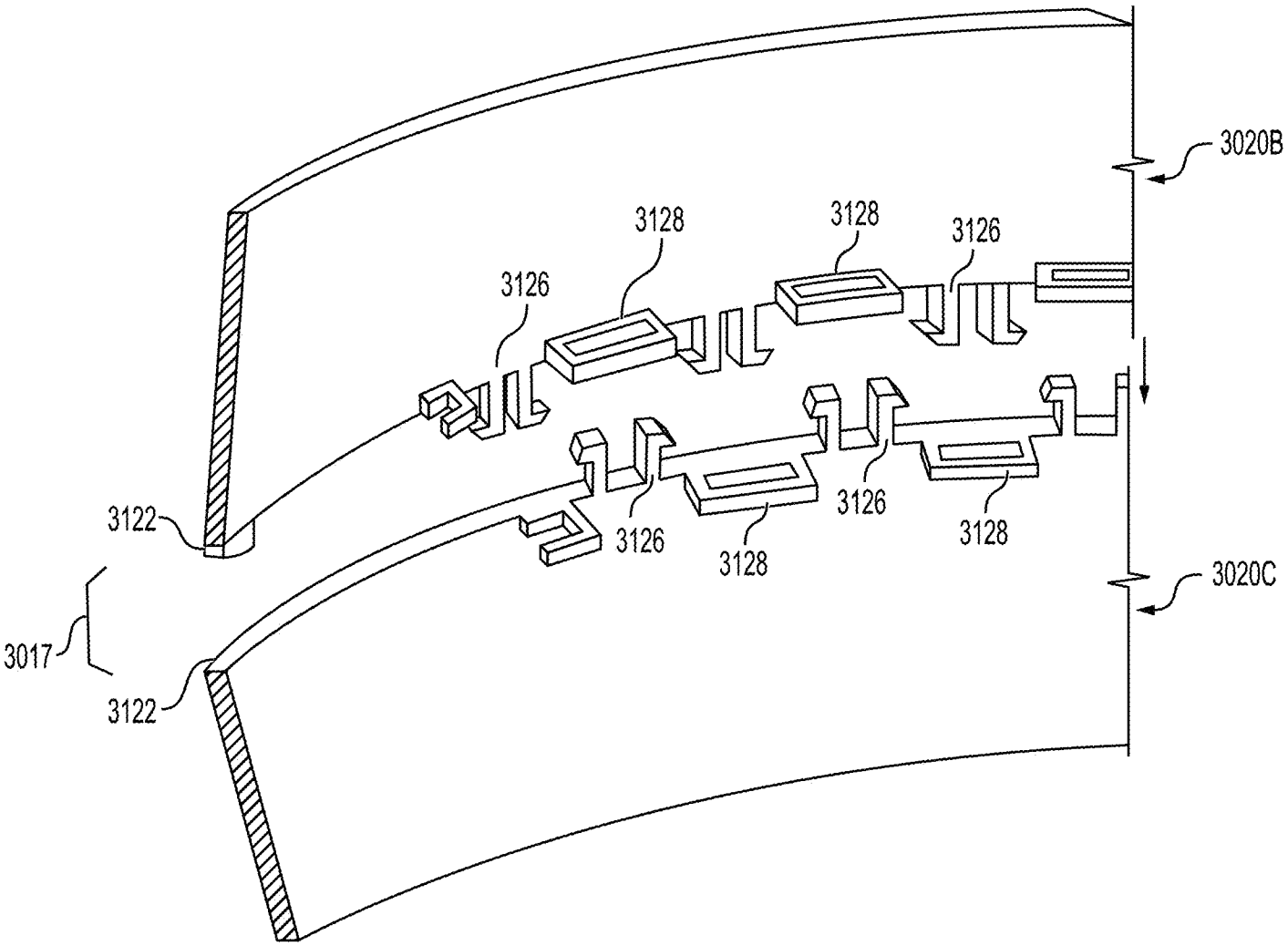
FIG. 32 depicts an interior perspective view of a portion of a riser assembly comprising two risers having circumferentially deflecting latches.

FIG. 32 illustrates the formation of joint 3017 by joining risers 3020B and 3020C. As the risers are pressed together, circumferentially deflecting latches 3126 interface with receivers 3128. Due to the sloped lips of the latches 3126 (described in more detail in FIGS. 33A-C), the latches 3126 deflect circumferentially (as opposed to radially) and lock into the receiver 3128. FIG. 34 illustrates a cross section view depicting joints 3017 formed by the connection of latches 2126 with receivers 3138 and joint 3017 formed by the connection of latches 2146 with receivers 2148. Both latches and receivers of joint 3015 and joint 3017 may be positioned on the interior surface of the riser sections.

Figure 33A:
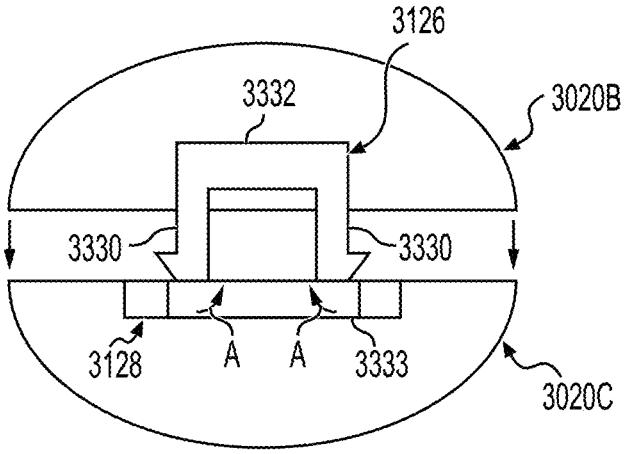
FIG. 33A depicts an elevation view of a circumferentially deflecting latch prior to connecting two risers together.
Figure 33B:
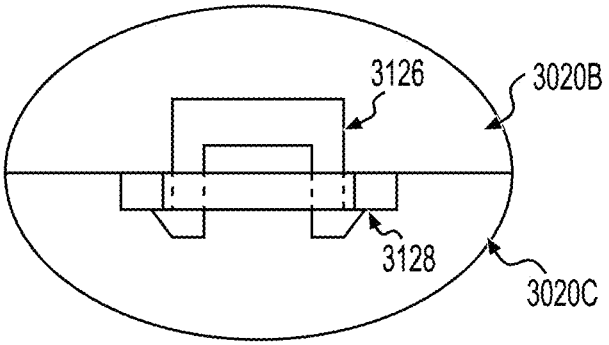
FIG. 33B depicts the circumferentially deflecting latch of FIG. 33A after the two risers are connected together.
Figure 33C:
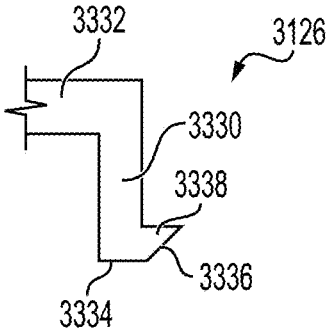
FIG. 33C depicts a partial elevation view of a circumferentially deflecting latch.
Figure 34:
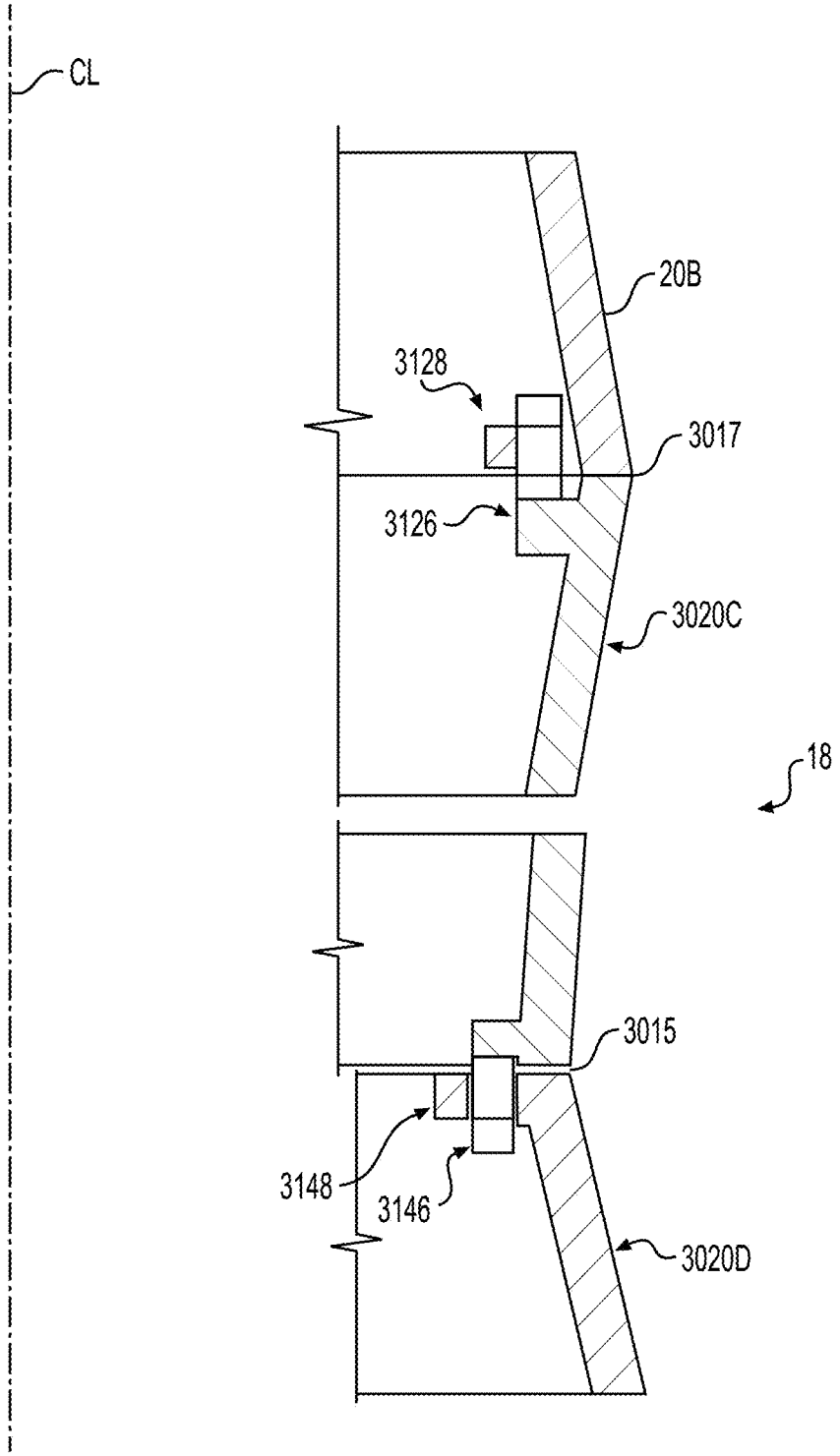
FIG. 34 depicts a cross section view of a portion of a riser assembly comprising three risers having circumferentially deflecting latches connected.

FIG. 33A illustrates a circumferentially deflecting latch 3126 as it is being connected into a receiver 3128, with arrows depicting movement of the latch as riser 3020B is joined to riser 3020C to form a joint. Circumferentially deflecting latch 3126 includes a base portion 3332 and two tines or prongs 3330. Receiver 3128 includes a cavity 3333 to receive the two tines 3330 on each latch 3126. As shown in FIG. 33C, the ends of tines 3330 include a flat portion 3338, a sloped lip 3336, and an end surface 3334. As shown in FIGS. 33A-C, the sloped lip 3336 will deflect circumferentially when the latch 3126 begins to engage with the receiver 3128 due to the sloped surface. The tines 3330 bend or flex circumferentially and spring back into their original position once the sloped lip 3336 clears the receiver 3128, resulting in the flat portion 3338 resting on the receiver 3128.

Figure 35:
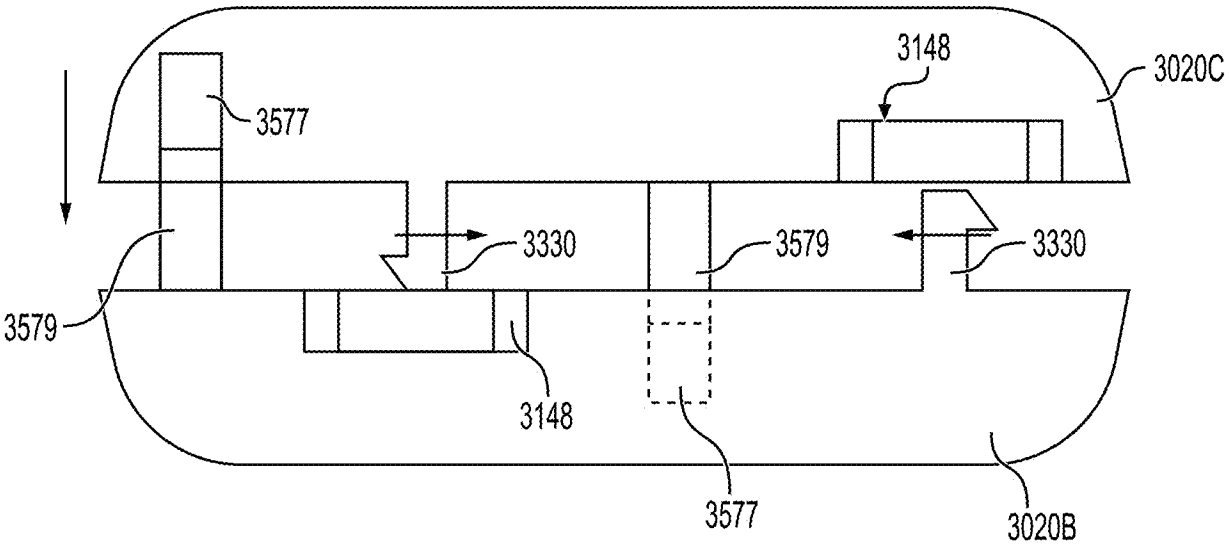
FIG. 35 depicts a section view of another embodiment view of a riser assembly comprising two risers having circumferentially deflecting latches.

FIG. 35 illustrates another embodiment of a riser that incorporates guiding posts and slots. For example, riser 3020C may include posts 3579 aligned to engage with a cavity 3577 in the corresponding riser 3020B. Riser 3020B may have a reciprocating post 3579 aligned with a cavity 3577 of riser 3020C. Such posts and receivers may be configured to assist an installer in aligning the two risers to ensure the tines 3330 of each latch 3126/3146 properly align and engage with a receiver 3128/3148 and do not otherwise miss engagement with receivers due to poor alignment.

Assembled structures embodying features of the present invention may be put to other uses including, for example, manhole sleeves for access to subterranean chambers. An open-ended hollow article like a riser, made in accord with the invention, may be fitted with a bottom closure (and optionally a top also), thus making the article into a bucket or tank like vessel, suitable for storing water, other liquids, or solid items. A claim to a riser shall be construed as comprehending a structure which may be used for a manhole in the earth or other material, or for a structure which forms part of a vessel. For convenience of description, the invention has at least in part been described with respect to a particular orientation, and such terms as top, bottom, side, etc., that relate to orientation shall not be construed as limiting with respect to the claims.

The examples presented herein are for purposes of illustration, and not limitation. Further, the boundaries of the functional building blocks have been arbitrarily defined herein for the convenience of the description. Alternative boundaries can be defined so long as the specified functions and relationships thereof are appropriately performed. Alternatives (including equivalents, extensions, variations, deviations, etc., of those described herein) will be apparent to persons skilled in the relevant art(s) based on the teachings contained herein. Such alternatives fall within the scope and spirit of the disclosed embodiments. Also, the words "comprising," "having," "containing," and "including," and other similar forms are intended to be equivalent in meaning and be open ended in that an item or items following any one of these words is not meant to be an exhaustive listing of such item or items, or meant to be limited to only the listed item or items. It must also be noted that as used herein and in the appended claims, the singular forms "a," "an," and "the" include plural references unless the context clearly dictates otherwise.

The invention, with explicit and implicit variations and advantages, has been described and illustrated with respect to several embodiments. Those embodiments should be considered illustrative and not restrictive. Any use of words such as "preferred" and variations suggest a feature or combination which is desirable but which is not necessarily mandatory. Thus, embodiments lacking any such preferred feature or combination may be within the scope of the claims which follow. Persons skilled in the art may make various changes in form and detail of the invention embodiments which are described, without departing from the spirit and scope of the claimed invention.

It should be noted that the products and/or processes disclosed may be used in combination or separately. Additionally, embodiments are described with reference to the accompanying drawings. Wherever convenient, the same reference numbers are used throughout the drawings to refer to the same or like parts. While examples and features of disclosed principles are described herein, modifications, adaptations, and other implementations are possible without departing from the spirit and scope of the disclosed embodiments. It is intended that the prior detailed description be considered as exemplary only, with the true scope and spirit being indicated by the following claims.

What is claimed is:

1. A first riser for use in a riser assembly to provide access to a below-grade chamber, wherein the first riser comprises:

an angled wall connecting a first end and a second end spaced apart along a central lengthwise axis;

wherein the first end is circular and comprises:

a first diameter;

a first plurality of latches spaced around the first end and extending to a first terminal end, each latch comprising a radially extending lip and a canted terminal end surface, wherein the radially extending lip and the canted terminal end surface extend away from the central lengthwise axis; and a first plurality of receivers spaced between the first plurality of latches wherein each of the first plurality of receivers comprises a first bar extending away from the central lengthwise axis in a circumferential direction around the first end to define a first receiver opening;

wherein the second end is circular and comprises:

a second diameter;

a second plurality of latches spaced around the second end and extending to a second terminal end that comprises a radially extending lip and a canted terminal end surface, wherein the radially extending lip and the canted terminal end extend towards the central lengthwise axis; and a second plurality of receivers spaced between the second plurality of latches wherein each of the second plurality of receivers comprises a second bar extending towards the central lengthwise axis in a circumferential direction around the second end to define a second receiver opening.

2. The first riser of claim 1, wherein the first end of the first riser is mated to a first end of a second riser, wherein the canted terminal end surface of the first riser contacts a bar portion of the second riser and the radially extending lip is deflected radially inwardly by contact of the terminal end surface of the riser with the bar portion of the second riser.

3. The first riser of claim 2, wherein the second end of the first riser is mated to a second end of a third riser, wherein the canted terminal end surface of the first riser contacts a bar portion of the third riser and the radially extending lip is deflected radially inwardly by contact of the terminal end surface of the riser with the bar portion of the third riser.

4. The first riser of claim 1, wherein the first diameter is larger than the second diameter.

5. The first riser of claim 1, wherein at least one of the first plurality of latches further comprises a tapered wall extending from the first end to the first terminal end.

6. The first riser of claim 1, wherein at least one of the second plurality of latches further comprises a tapered wall extending from the first end to the first terminal end.

7. The first riser of claim 1, wherein at least one of the first plurality of receivers comprises a tapered wall extending from the first end to the first bar.

8. The first riser of claim 1, wherein at least one of the first plurality of receivers is open on one of its circumferential ends.

* * * * *